US009073725B2

(12) United States Patent
Arakane

(10) Patent No.: US 9,073,725 B2
(45) **Date of Patent: *Jul. 7, 2015**

(54) INKJET PRINTER

(71) Applicant: BROTHER KOGYO KABUSHIKI KAISHA, Nagoya, Aichi (JP)

(72) Inventor: Satoru Arakane, Aichi (JP)

(73) Assignee: BROTHER KOGYO KABUSHIKI KAISHA, Nagoya, Aichi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/341,080

(22) Filed: Jul. 25, 2014

(65) Prior Publication Data

US 2015/0029254 A1 Jan. 29, 2015

(30) Foreign Application Priority Data

Jul. 29, 2013 (JP) ..... 2013-156391

(51) Int. Cl.
*B41J 29/38* (2006.01)
*B65H 29/70* (2006.01)
(Continued)

(52) U.S. Cl.
CPC ..... *B65H 29/70* (2013.01); *B65H 5/062* (2013.01); *B41J 29/393* (2013.01); *B41J 2/04503* (2013.01); *B41J 2/04556* (2013.01)

(58) Field of Classification Search
CPC ..... B41J 29/393; B41J 11/007; B41J 11/008; B41J 11/42; B41J 25/308; B41J 19/76; B41J 2/04503; B41J 2/04556
USPC ..... 347/8, 9, 14, 16, 37, 101, 104
See application file for complete search history.

(56) References Cited

U.S. PATENT DOCUMENTS 5,874,979 A 2/1999 Ohyama
6,471,315 B1 10/2002 Kurata
(Continued)

FOREIGN PATENT DOCUMENTS

JP 05-155009 A 6/1993
JP 9-48161 A 2/1997
(Continued)

OTHER PUBLICATIONS

Notice of Allowance dated Feb. 11, 2015 issued in U.S. Appl. No. 14/107,035.
(Continued)

*Primary Examiner* — An Do
(74) *Attorney, Agent, or Firm* — Scully, Scott, Murphy & Presser, P.C.

(57) ABSTRACT

An inkjet printer having a conveyer, a recording head, a carriage, a corrugation mechanism, and a controller is provided. The controller executes an operation including a conveying step to convey a sheet and a recording step to discharge ink through the recording head toward the sheet. The recording step includes a discharging step, in which the recording head is manipulated to discharge the ink toward the sheet in response to the carriage being placed in a discharging position when the sheet is in a nipped condition, in which the sheet is nipped by the conveyer roller unit; and a corrected discharging step, in which the recording head is manipulated to discharge the ink toward the sheet in response to the carriage being placed in a corrected discharging position, when the sheet is in a non-nipped condition, in which the sheet is not nipped by the conveyer roller unit.

20 Claims, 13 Drawing Sheets

(51) Int. Cl.

| | |
|---|---|
| ***B65H 5/06*** | (2006.01) |
| ***B41J 29/393*** | (2006.01) |
| ***B41J 2/045*** | (2006.01) |

(56) References Cited

U.S. PATENT DOCUMENTS

| | | | | |
|---|---|---|---|---|
| 7,237,858 | B2 * | 7/2007 | Igarashi | 347/8 |
| 8,567,905 | B2 * | 10/2013 | Ogasawara | 347/37 |
| 2004/0126164 | A1 | 7/2004 | Ohyama | |
| 2005/0088471 | A1 | 4/2005 | Endo | |
| 2007/0291056 | A1 | 12/2007 | Tanahashi et al. | |
| 2009/0219322 | A1 | 9/2009 | Terada | |
| 2010/0039473 | A1 | 2/2010 | Terada | |
| 2010/0244357 | A1 | 9/2010 | Takahata | |
| 2011/0063352 | A1 | 3/2011 | Sakurada et al. | |
| 2011/0157269 | A1 | 6/2011 | Teramae | |
| 2011/0175958 | A1 | 7/2011 | Sato et al. | |
| 2011/0298854 | A1 | 12/2011 | Sakurada et al. | |
| 2014/0168300 | A1 | 6/2014 | Kubo et al. | |
| 2014/0204141 | A1 * | 7/2014 | Arakane | 347/14 |

FOREIGN PATENT DOCUMENTS

| | | | |
|---|---|---|---|
| JP | 11-240146 | A | 9/1999 |
| JP | 2004-017586 | A | 1/2004 |
| JP | 2004-106978 | A | 4/2004 |
| JP | 2005-246642 | A | 9/2005 |
| JP | 2006-102997 | A | 4/2006 |
| JP | 2006-192636 | A | 7/2006 |
| JP | 2007-144718 | A | 6/2007 |
| JP | 2007-331297 | A | 12/2007 |
| JP | 2007-331315 | A | 12/2007 |
| JP | 2008-221729 | A | 9/2008 |
| JP | 2009-128822 | A | 6/2009 |
| JP | 2009-143152 | A | 7/2009 |
| JP | 2009-196367 | A | 9/2009 |
| JP | 2009-202430 | A | 9/2009 |
| JP | 2009-208273 | A | 9/2009 |
| JP | 2010-042646 | A | 2/2010 |
| JP | 2011-079296 | A | 4/2011 |
| JP | 2014-136419 | A | 7/2014 |
| JP | 2014-139002 | A | 7/2014 |

OTHER PUBLICATIONS

U.S. Office Action dated Sep. 4, 2014 received in U.S. Appl. No. 14/107,035.

U.S. Office Action dated Nov. 19, 2014 received in U.S. Appl. No. 14/341,015.

U.S. Office Action dated Dec. 24, 2014 received in U.S. Appl. No. 14/158,000.

U.S. Appl. No. 14/341,015, filed Jul. 25, 2014.

U.S. Office Action dated Mar. 20, 2015 issued in U.S. Appl. No. 14/158,000.

Notice of Allowance dated Mar. 20, 2015 issued in U.S. Appl. No. 14/341,015.

* cited by examiner

| REFERENCE VALUE | D0 | | | | | | | | |
|---|---|---|---|---|---|---|---|---|---|
| PEAK DEVIATION VALUE | $Y_{(2)}$ | $Y_{(4)}$ | $Y_{(6)}$ | $Y_{(8)}$ | $Y_{(10)}$ | $Y_{(12)}$ | $Y_{(14)}$ | $Y_{(16)}$ | |
| BOTTOM DEVIATION VALUE | $Y_{(1)}$ | $Y_{(3)}$ | $Y_{(5)}$ | $Y_{(7)}$ | $Y_{(9)}$ | $Y_{(11)}$ | $Y_{(13)}$ | $Y_{(15)}$ | $Y_{(17)}$ |
| ADJUSTING VALUE $\gamma$ | $\gamma_{(1)}$ | $\gamma_{(2)}$ | $\gamma_{(3)}$ | $\gamma_{(4)}$ | $\gamma_{(5)}$ | $\gamma_{(6)}$ | ··· | $\gamma_{(16)}$ | $\gamma_{(17)}$ |
| SHIFTING VALUE $\delta$ | $\delta 1$ | | | | $\delta 2$ | | | | |

FIG. 13

INKJET PRINTER

CROSS-REFERENCE TO RELATED APPLICATION

This application claims priority under 35 U.S.C. §119 from Japanese Patent Application No. 2013-156391 filed on Jul. 29, 2013. The entire subject matter of the application is incorporated herein by reference.

BACKGROUND

1. Technical Field

The following description relates to an inkjet printer.

2. Related Art

An inkjet printer capable of recording an image by discharging ink from a recording head onto a recording sheet is known. The inkjet printer may be equipped with a corrugating mechanism to deform the recording sheet in a rippled shape waving up and down along a widthwise direction, which is orthogonal to a direction in which the recording sheet is conveyed.

In particular, the inkjet printer may be equipped with a platen and a sheet-pressing plate. The platen may be formed to have convex portions and concave portions on an upper surface thereof. The sheet-pressing plate may be configured to press the recording sheet toward the platen. The sheet-pressing plate may be formed to have a plurality of projections, which project toward the concave portions of the platen. In an upstream position according to a flow of the sheet-conveying direction, a conveyer roller unit may be disposed.

As the conveyer roller unit conveys the recording sheet to the platen, the recording sheet may be deformed in a corrugated shape according to the shape of the plurality of projections formed in the sheet-pressing plate and the convex and concave portions of the platen. The recording sheet in the corrugated shape may be conveyed downstream to a pair of ejection rollers, which are disposed on a downstream side of the platen with regard to the sheet-conveying direction.

SUMMARY

Aspects of the present invention are advantageous in that a technique to prevent an image forming quality from being lowered, even when the recording sheet corrugated by the corrugating mechanism is in a downstream position with respect to the conveyer roller unit, is provided.

According to an aspect of the present invention, an inkjet printer is provided. The inkjet printer includes a conveyer having a conveyer roller unit, the conveyer roller unit being configured to nip a sheet and convey the sheet along a conveyance direction; a recording head configured to discharge ink toward the sheet conveyed by the conveyer; a carriage mounting the recording head thereon and configured to move along a scanning direction; a corrugation mechanism configured to shape the sheet into a corrugated shape, in which an amount of a gap between the recording head and the sheet is increased and decreased alternately along the scanning direction, at a corrugating position between the conveyer roller unit and the recording head; and a controller. The controller is configured to execute an operation including a conveying step, in which the sheet is conveyed by the conveyer; and a recording step, in which the carriage is moved and the recording head is manipulated to discharge ink toward the sheet. The recording step includes a discharging step, in which the recording head is manipulated to discharge the ink toward the sheet in response to the carriage being placed in a discharging position when the sheet is in a nipped condition, in which the sheet is nipped by the conveyer roller unit; and a corrected discharging step, in which the recording head is manipulated to discharge the ink toward the sheet in response to the carriage being placed in a corrected discharging position, where the corrected discharging position is different from the discharging position, when the sheet is in a non-nipped condition, in which the sheet is not nipped by the conveyer roller unit.

According to another aspect of the present invention, an inkjet printer is provided. The inkjet printer includes a conveyer including a conveyer roller unit, the conveyer roller unit being configured to nip a sheet and convey the sheet along a conveyance direction; a recording head configured to discharge ink toward the sheet conveyed by the conveyer; a carriage mounting the recording head thereon and configured to move along a scanning direction; a corrugation mechanism configured to shape the sheet into a corrugated shape at a corrugating position between the conveyer roller unit and the recording head; and a controller. The controller is configured to execute an operation including a conveying step, in which the sheet is conveyed by the conveyer; and a recording step, in which the carriage is moved and the recording head is manipulated to discharge ink toward the sheet. The recording step includes a discharging step, in which the recording head is manipulated to discharge the ink toward the sheet in response to the carriage being placed in a discharging position when a tail end of the sheet is in a position on a downstream side of the conveyer roller unit; and a corrected discharging step, in which the recording head is manipulated to discharge the ink toward the sheet in response to the carriage being placed in a corrected discharging position, where the corrected discharging position is different from the discharging position, when the tail end of the sheet is in a position between the conveyer roller unit and the corrugating position.

According to still another aspect of the present invention, a method including steps of conveying the sheet by a conveyer comprising a conveyer roller unit, the conveyer roller unit being configured to nip the sheet and convey the sheet; and recording by moving a carriage in a scanning direction, and manipulating a recording head mounted on the carriage to discharge ink toward the sheet shaped into a corrugated shape along the scanning direction, is provided. The step of recording includes a discharging step, in which the recording head is manipulated to discharge the ink toward the sheet in response to the carriage being placed in a discharging position when the sheet is in a nipped condition, in which the sheet is nipped by the conveyer roller unit; and a corrected discharging step, in which the recording head is manipulated to discharge the ink toward the sheet in response to the carriage being placed in a corrected discharging position, where the corrected discharging position is different from the discharging position, when the sheet is in a non-nipped condition, in which the sheet is not nipped by the conveyer roller unit.

BRIEF DESCRIPTION OF THE ACCOMPANYING DRAWINGS

Figure 5:
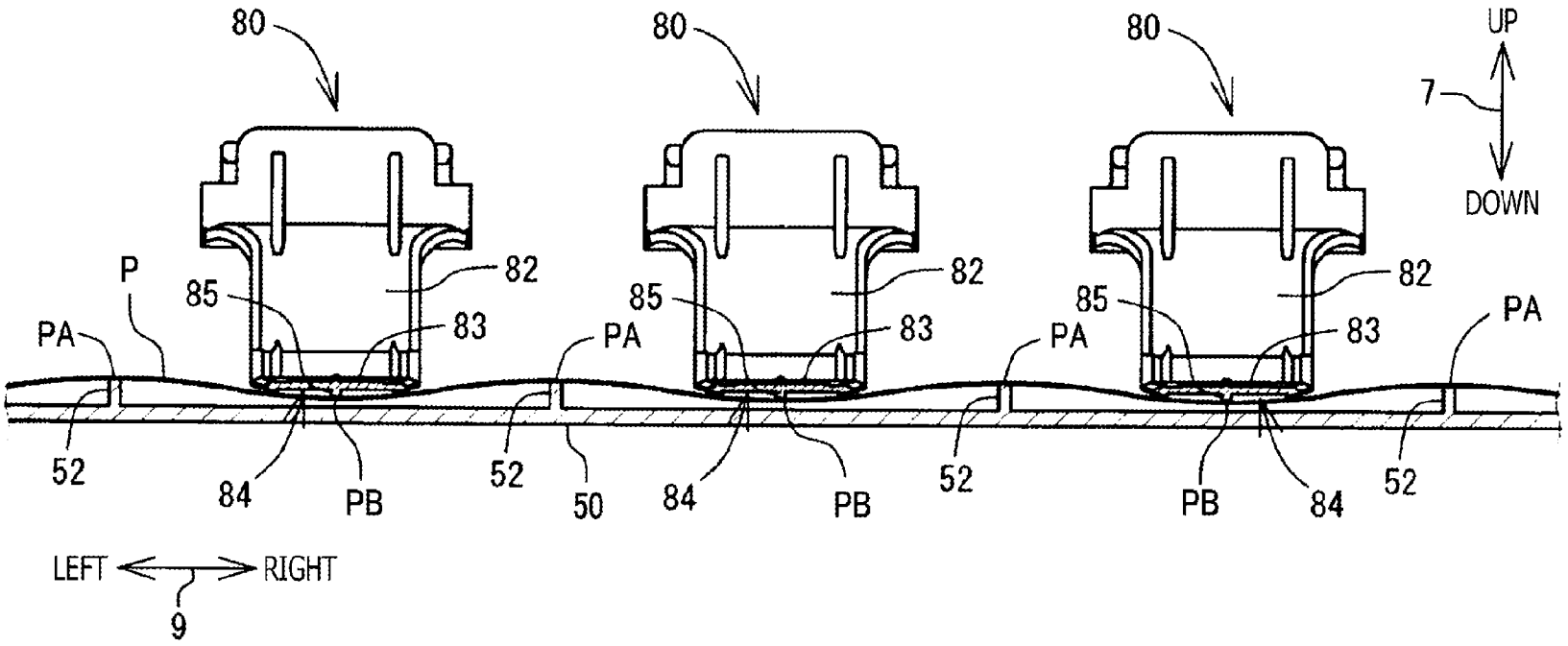

FIG. 5 is a cross-sectional view to illustrate relative positions between supporting ribs 52 in the platen 50 and contacting ribs 85 in the contact pieces 80 in the MFD 10.

Figure 6:
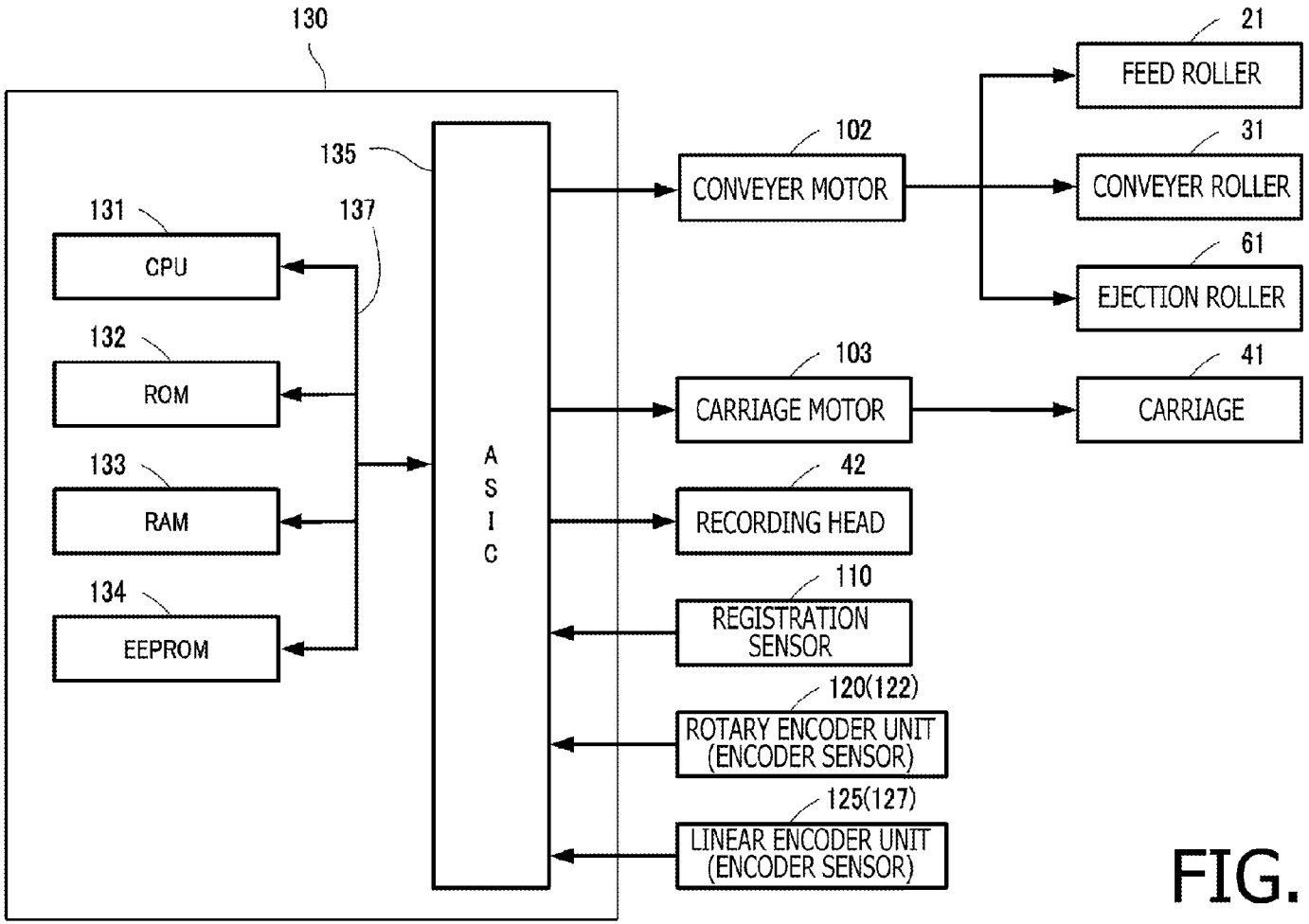

FIG. 6 is a block diagram to illustrate configurations of a controller 130 and other related parts in the MFD 10.

Figure 7:
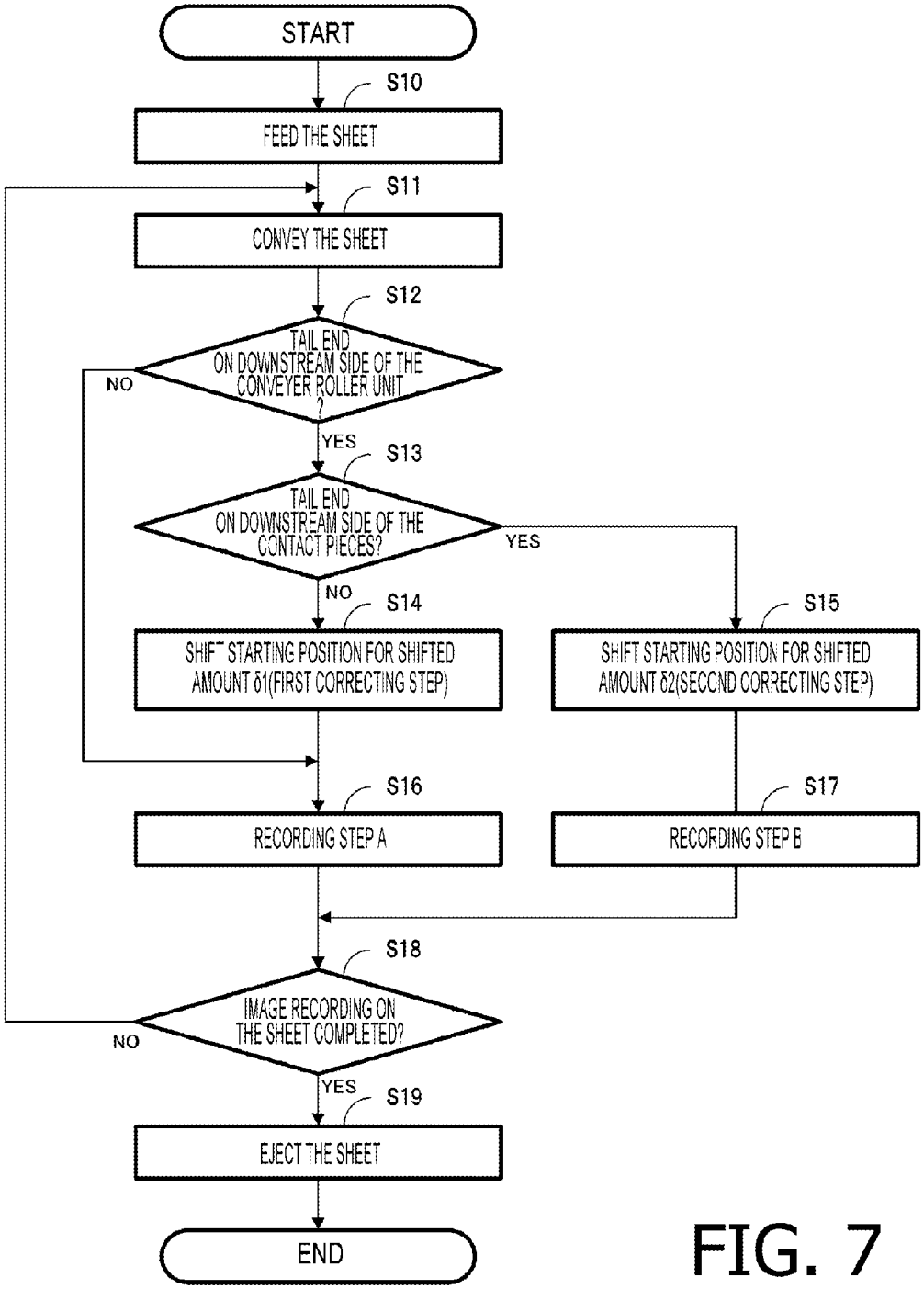

FIG. 7 is a flowchart to illustrate a flow of an image recording operation to be performed by the controller 130 in the MFD 10.

Figure 8:
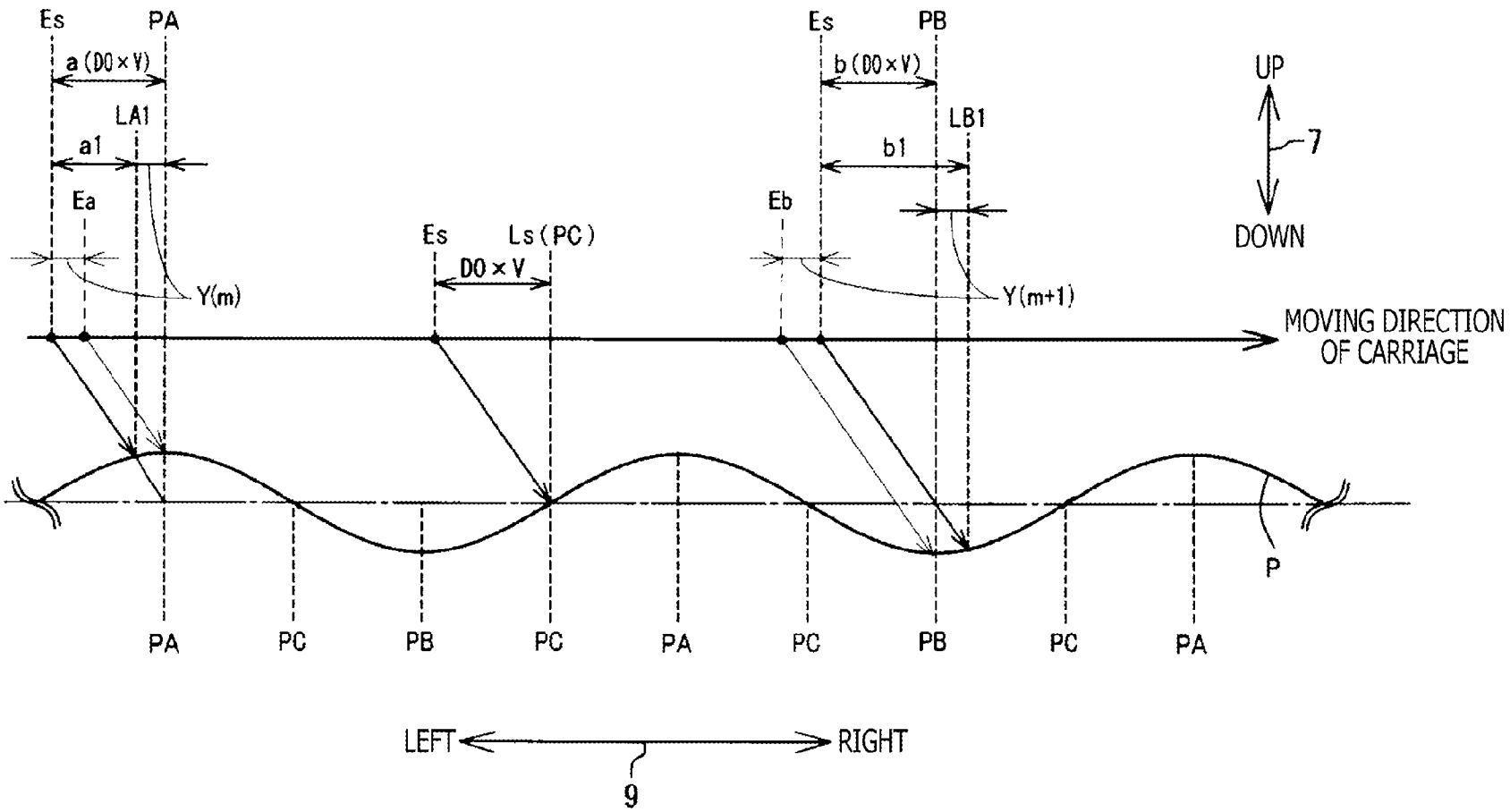

FIG. 8 is a diagram to illustrate a reference value D0, a peak deviation value Y (m), and a bottom deviation value Y (m+1) with respect to a sheet P in the MFD 10.

Figure 9A:
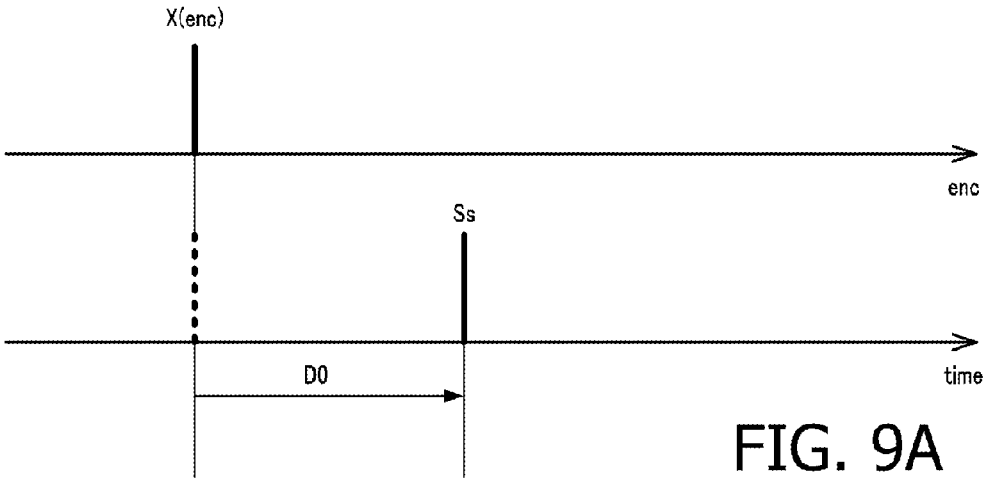
Figure 9B:
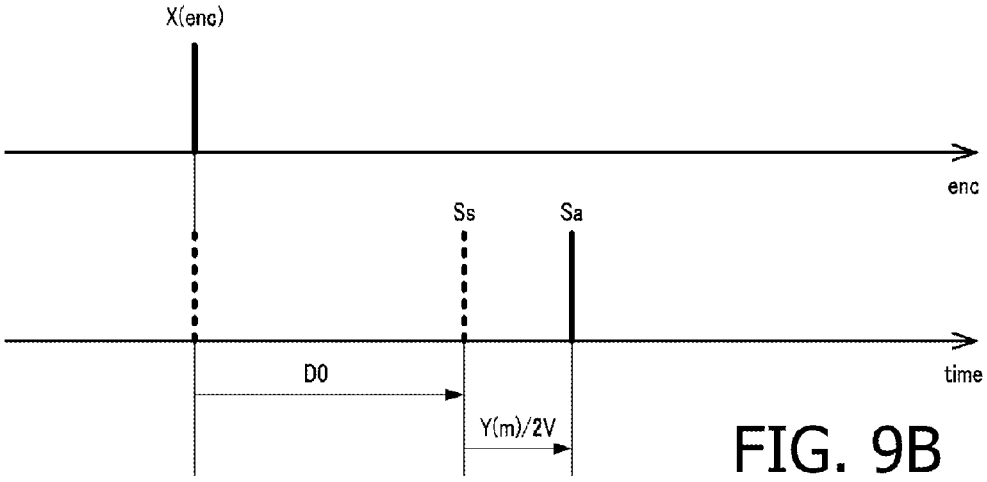
Figure 9C:
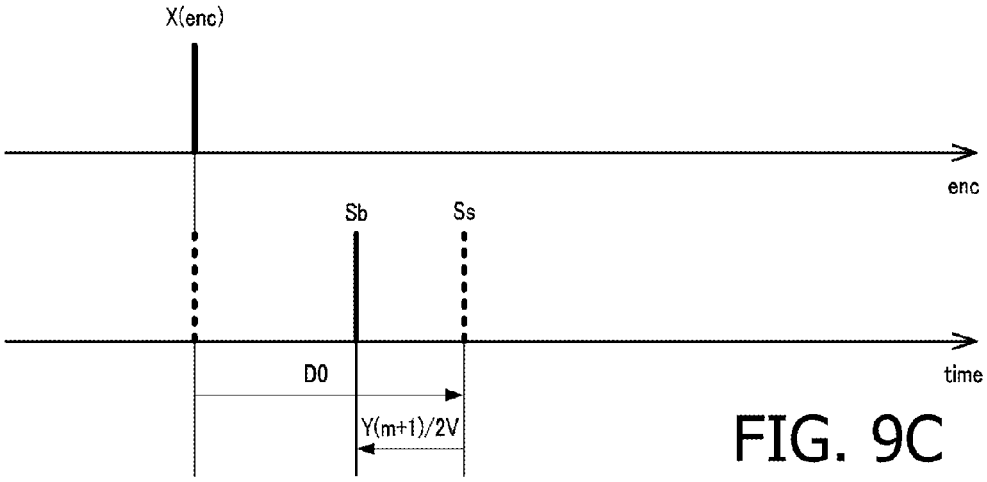

FIGS. 9A-9C are diagrams to illustrate relation between pulse signals generated by a linear encoder unit 125 and discharging timings Es, Ea, Eb to discharge ink in the MFD 10.

FIGS. 10A-10F illustrate behaviors of the sheet P being conveyed in a rear-to-front direction 8 toward downstream and moving along a widthwise direction 9 in the MFD 10.

Figure 11A:
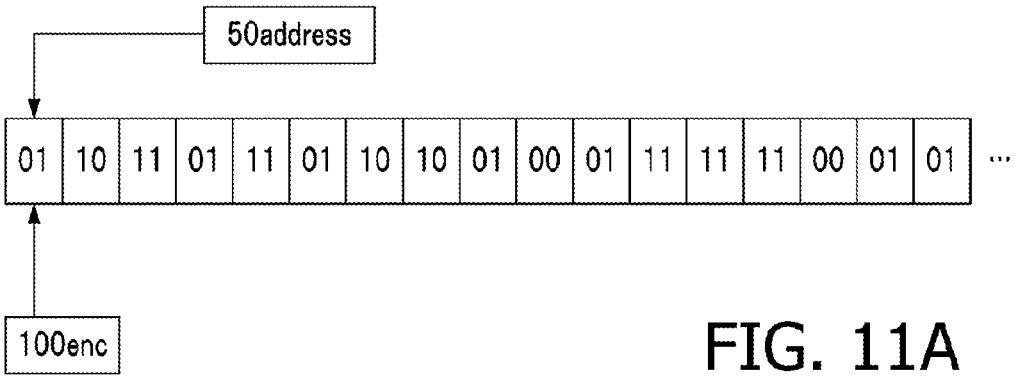
Figure 11B:
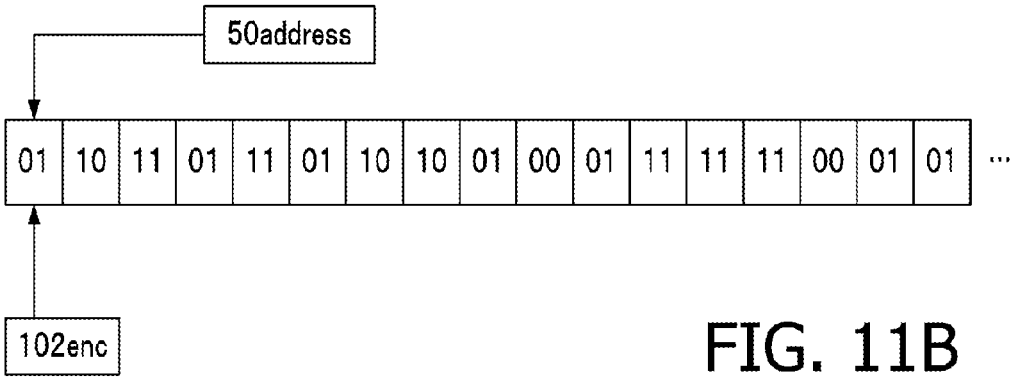
Figure 11C:
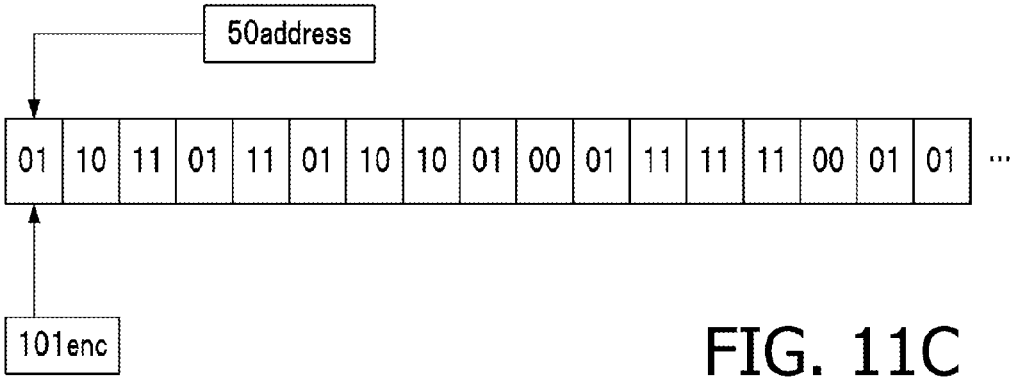

FIG. 11A-11C illustrate a data structure of data units stored in a RAM 133 and a method to set the data units to an ASIC 135 in the MFD 10.

Figure 12:
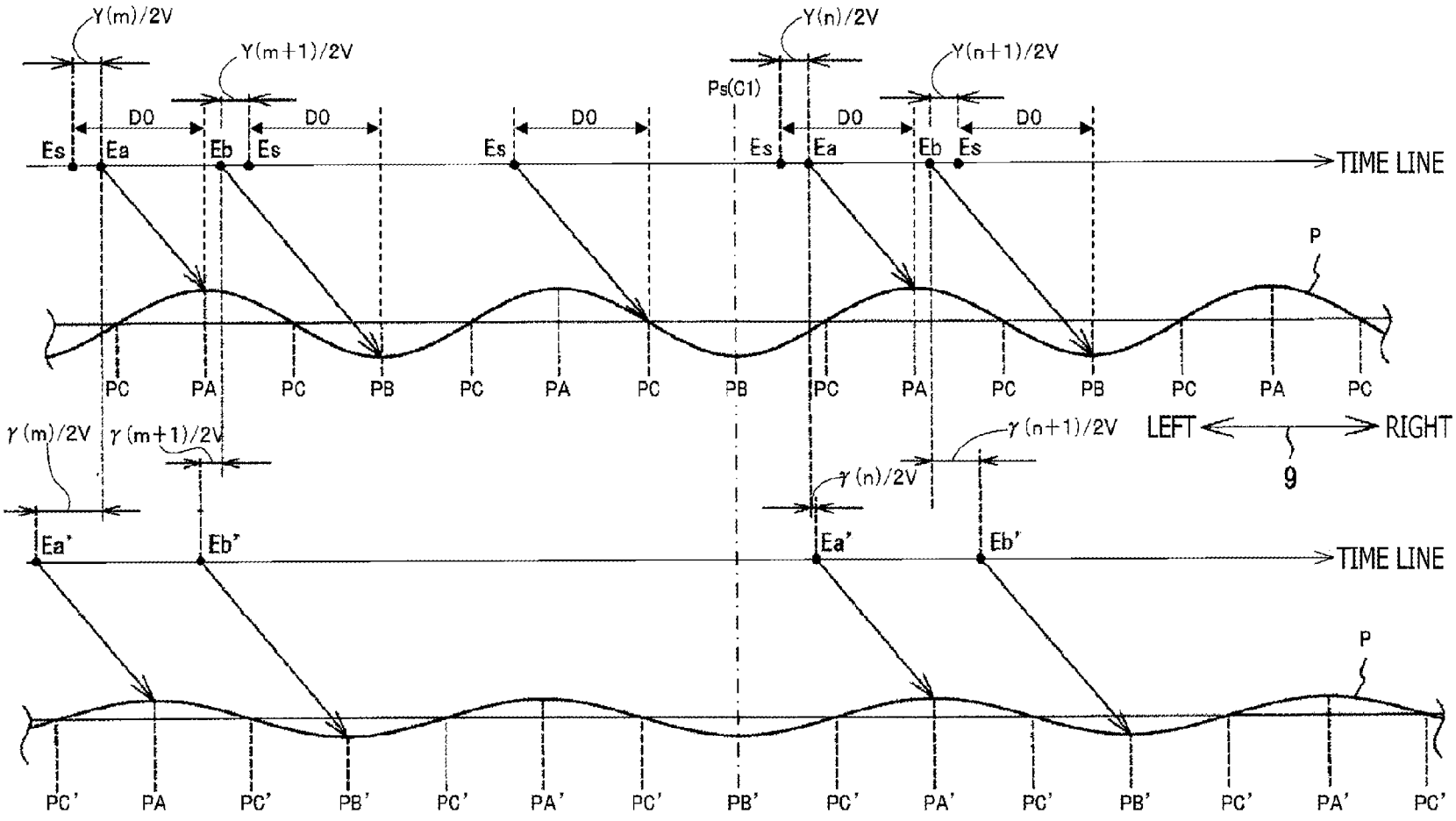

FIG. 12 illustrates a shape of the sheet P when a tail end of the sheet P is on an upstream side of a conveyer roller unit 30 and a shape of the sheet P when the tail end of the sheet P is on a downstream side of the conveyer roller unit 30 in the MFD 10.

FIG. 13 illustrates a data structure in an EEPROM 134 in the MFD 10.

DETAILED DESCRIPTION

Hereinafter, an embodiment according to an aspect of the present invention will be described in detail with reference to the accompanying drawings. It is noted that various connections are set forth between elements in the following description. These connections in general, and unless specified otherwise, may be direct or indirect and that this specification is not intended to be limiting in this respect. Aspects of the invention may be implemented in computer software as programs storable on computer readable media including but not limited to RAMs, ROMs, flash memories, EEPROMs, CD-media, DVD-media, temporary storage, hard disk drives, floppy drives, permanent storage, and the like.

Figure 1:
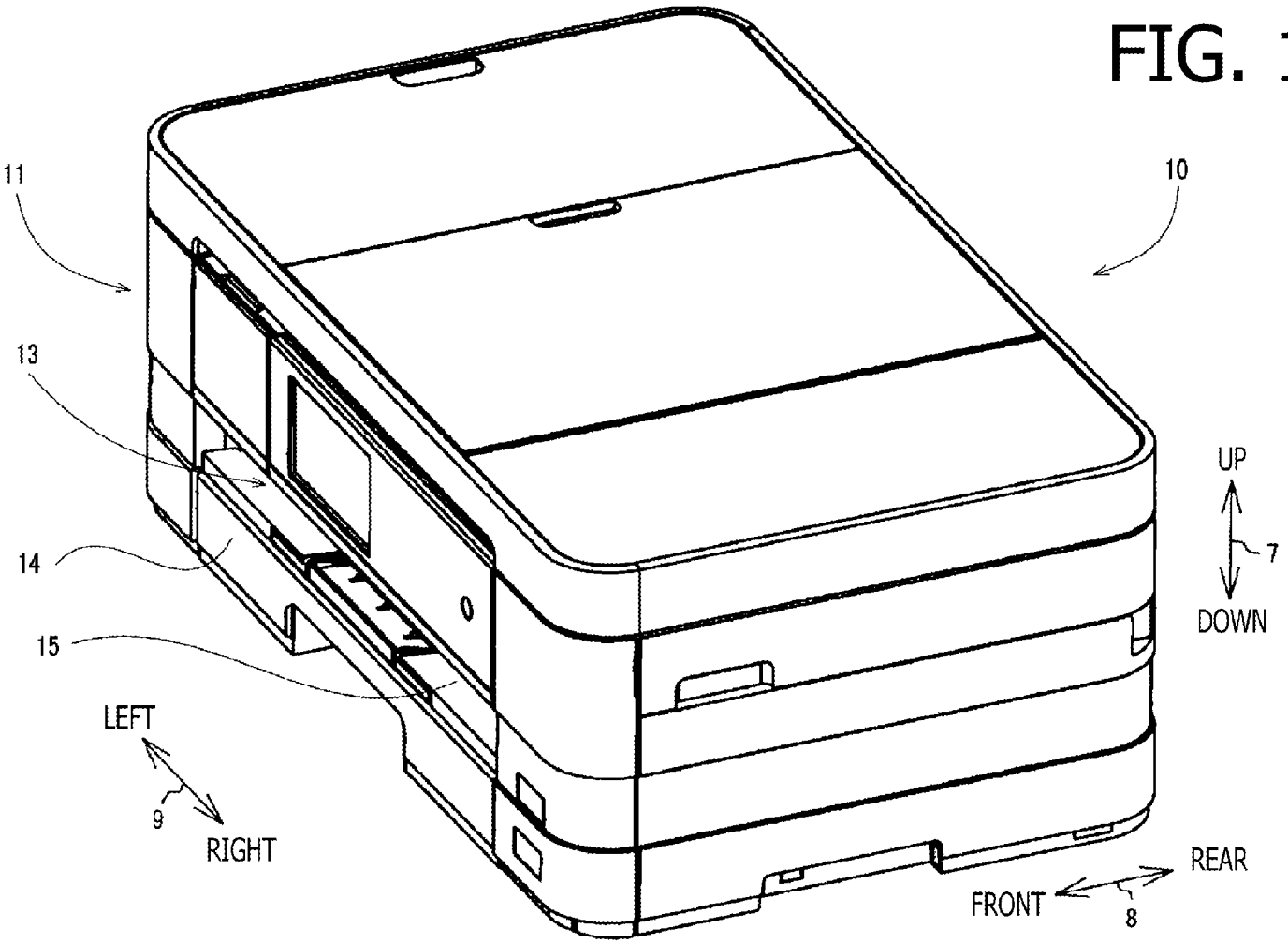
FIG. 1 is an external perspective view of a multifunction device (MFD) 10.

In the following description, a vertical direction 7 is defined with reference to an up-to-down or down-to-up direction for the MFD 10 in an ordinarily usable posture (see FIG. 1). In other words, the up-to-down or down-to-up direction in FIG. 1 coincides with the vertical direction 7. Further, other directions concerning the MFD 10 will be referred to based on the ordinarily usable posture of the MFD 10: a viewer's lower-left side in FIG. 1, on which an opening 13 is formed, is defined to be a front side of the MFD 10, and a side opposite from the front side, i.e., a viewer's upper-right side, is defined as a rear side of the MFD 10. A front-to-rear or rear-to-front direction is defined as a direction of depth and may be referred to as a front-rear direction 8. An upper-left side in FIG. 1, which comes on the user's left-hand side with respect to the MFD 10 when the user faces the front side, is referred to as a left side or a left-hand side. A side opposite from the left, which is on the viewer's lower-right side, is referred to as a right side or a right-hand side. A right-to-left or left-to-right direction of the MFD 10 may also be referred to as a right-left direction 9 or a widthwise direction 9. The directions shown in FIGS. 2-5 and 10A-10F correspond to those indicated by the arrows appearing in FIG. 1.

[Overall Configuration of the MFD 10]

An overall configuration of the MFD 10 will be described with reference to FIG. 1. As depicted in FIG. 1, the MFD 10 has an overall shape of a six-sided rectangular box and contains a printer unit 11, in which an image can be recorded on a sheet P (see FIG. 2) in an inkjet recording method, in a lower position thereof. In other words, the MFD 10 is equipped with a printing function. The MFD 10 is a multi-functional device having a plurality of functions, including, for example, a facsimile transmission receiving function, additionally to the printing function. The printer unit 11 is formed to have an opening 13 on a front side thereof. Through the opening 13, a feeder tray 14 to accommodate the recording sheets P may be detachably attached to the printer unit 11. An ejection tray 15 to catch ejected recording sheets P is arranged in an upper position with respect to the feeder tray 21.

[Overall Configuration of the Printer Unit 11]

Figure 2:
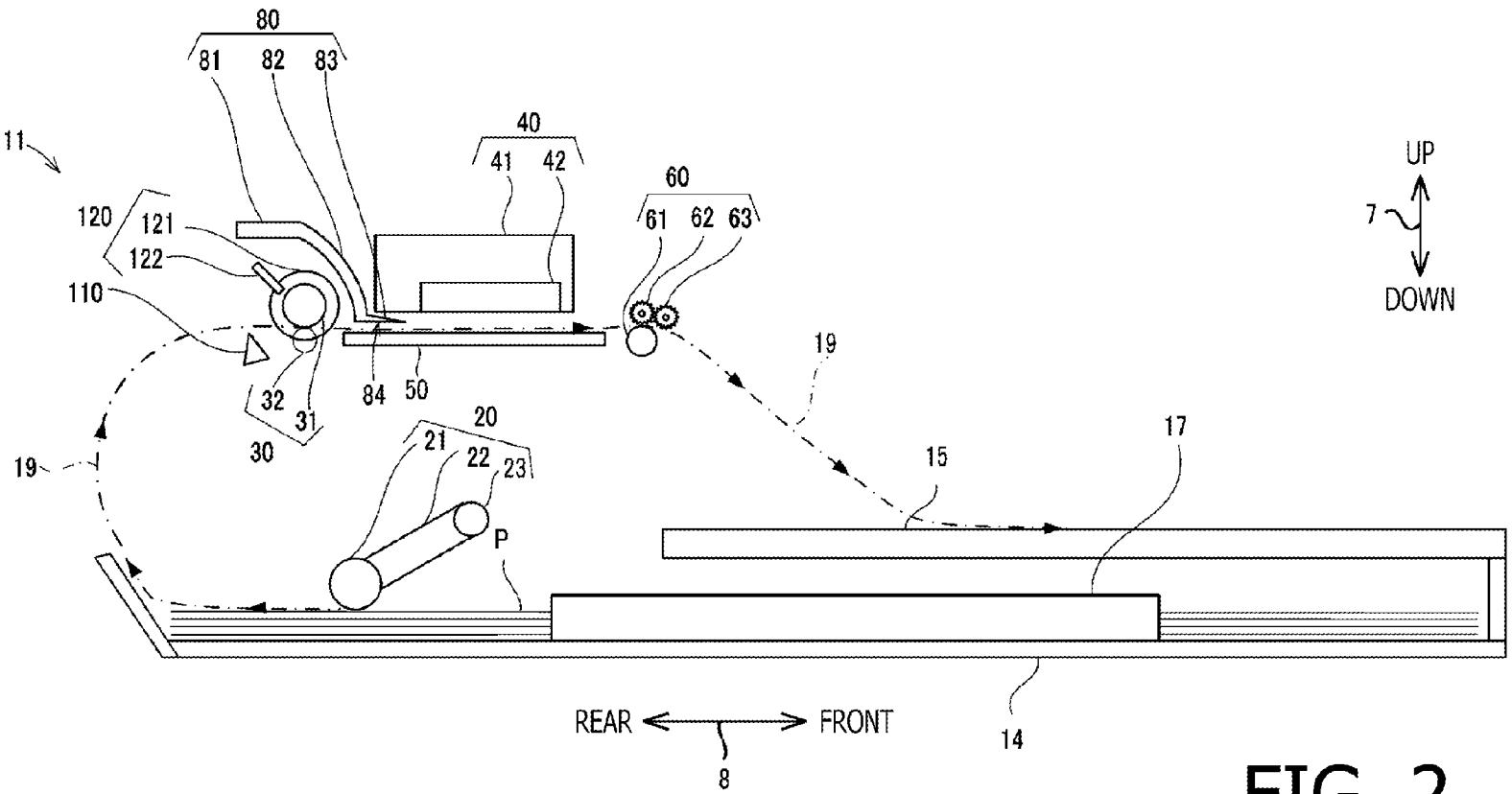
FIG. 2 is a cross-sectional view of an internal structure of a printer unit 11 in the MFD 10.

An overall configuration of the printer unit 11 will be described with reference to FIG. 2. As depicted in FIG. 2, the printer unit 11 includes a feeder unit 20, a conveyer roller unit 30, a recording unit 40, a platen 50, an ejection roller unit 60, and contact pieces 80. The sheet P is conveyed in the printer unit 11 along a direction of conveyance flow 19 indicated by a dash-and-dot line shown in FIG. 2.

The feeder unit 20 is configured to pick up the sheet P from the feeder tray 14 and to convey the picked-up sheet P along the conveyance flow 19 toward the conveyer roller unit 30. The conveyer roller unit 30 conveys the sheet P fed by the feeder unit 20 further downstream toward the recording unit 40 along the direction of conveyance flow 19. The recording unit 40 records an image on the sheet P conveyed by the conveyer roller unit 30. The ejection roller unit 60 ejects the sheet P with the image recorded thereon by the recording unit 40 in the ejection tray 15. The platen 50 supports the sheet P being conveyed by the conveyer roller unit 30. The contact pieces 80 press the sheet P being conveyed by the conveyer roller unit 30 downward toward the platen 50.

[Feeder Unit 20]

As depicted in FIG. 2, in an upper position with respect to the feeder tray 14, the feeder unit 20 is disposed. The feeder unit 20 includes a feed roller 21, a feeder arm 22, and a shaft 23. The feed roller 21 is rotatably attached to one end of the feeder arm 22, which is movable upward and downward to be closer to and farther from the feeder tray 14. The feed roller 21 is rotatable by a driving force, which is generated by a conveyer motor 102 (see FIG. 6). The feeder arm 22 is pivotably supported by the shaft 23, which is supported by a frame (not shown) of the printer unit 11. The feeder arm 22 is urged downward toward the feeder tray 14 by weight thereof and/or resilient force provided by, for example, a spring. When one or more recording sheets P are placed in the feeder tray 14, and when the feed roller 21 rotates, a topmost one of the recording sheets P placed in the feeder tray 14 is picked up and conveyed along the direction of conveyance flow 19 toward the feeder roller unit 30.

The feeder tray 14 is formed to have lateral guides 17, which are placed to fit with widthwise ends of the sheet P. Positions of the lateral guides 17 are adjusted manually by a user according to a size of the sheet P. While a widthwise position of the sheet P in the feeder tray 14 is restricted by the lateral guides 17, and while the feeder roller 21 is arranged in a widthwise central position in a sheet-conveying area where the sheet P is conveyed, even if the sheet-conveying area has a width greater than the width of the sheet P, the feeder roller 21 contacts an approximately widthwise center of the sheet P and rotates thereat. Thus, the sheet P is conveyed with the widthwise center thereof falling on the widthwise center of the area for the sheet P to be conveyed. This method to convey the sheet P with the widthwise center thereof matching with the widthwise center of the path may be referred to as a center-registration method. In this regard, however, it is to be noted that the widthwise center of the sheet P and the widthwise center of the path may not necessarily exactly coincide with each other. This conveying condition, in which the widthwise centers substantially match with each other, is maintained while the feeder roller 21 conveys the sheet P and while the conveyer roller unit 30 conveys the sheet P. Conveyance of the sheet P by the conveyer roller unit 30 will be described later in detail.

[Conveyer Roller Unit 30]

As depicted in FIG. 2, the conveyer roller unit 30 is disposed in a downstream position, on a downstream side, with respect to the feeder unit 20 along the direction of the conveyance flow 19. The conveyer roller unit 30 includes a conveyer roller 31 and a pinch roller 32. The conveyer roller 31 is driven by the conveyer motor 102. The pinch roller 32 is arranged to contact the conveyer roller 31. The pinch roller 32 includes a plurality of pinch rollers 32, which are arranged to align along the widthwise direction 9, i.e., along a direction to face FIG. 2 orthogonally. The pinch rollers 32 are urged against the conveyer roller 31 by urging members, such as springs. Therefore, when the conveyer roller 31 rotates, the pinch rollers 32 are rotated along with the rotation of the conveyer roller 31. The conveyer roller 31 and the pinch rollers 32 nip the sheet P in there-between in a sheet-nipping position and convey the sheet P downstream along the direction of the conveyed flow 19.

[Recording Unit 40]

As depicted in FIG. 2, the recording unit 40 is arranged in a downstream position with respect to the conveyer roller unit 30 along the direction of the conveyance flow 19. The recording unit 40 includes a carriage 41 and a recording head 42. The carriage 41 is movable along a main scanning direction, which is orthogonal to the direction of the conveyance flow 19. In other words, the carriage 41 is movable along the widthwise direction 9, i.e., along the direction to face FIG. 2 orthogonally. The recording head 42 is mounted on the carriage 41 and is movable along with the carriage 41. While ink is supplied to the recording head 42 from an ink cartridge (not shown), the recording head 42 discharges minute droplets of the ink through nozzles (not shown) formed on a bottom thereof.

Figure 3:
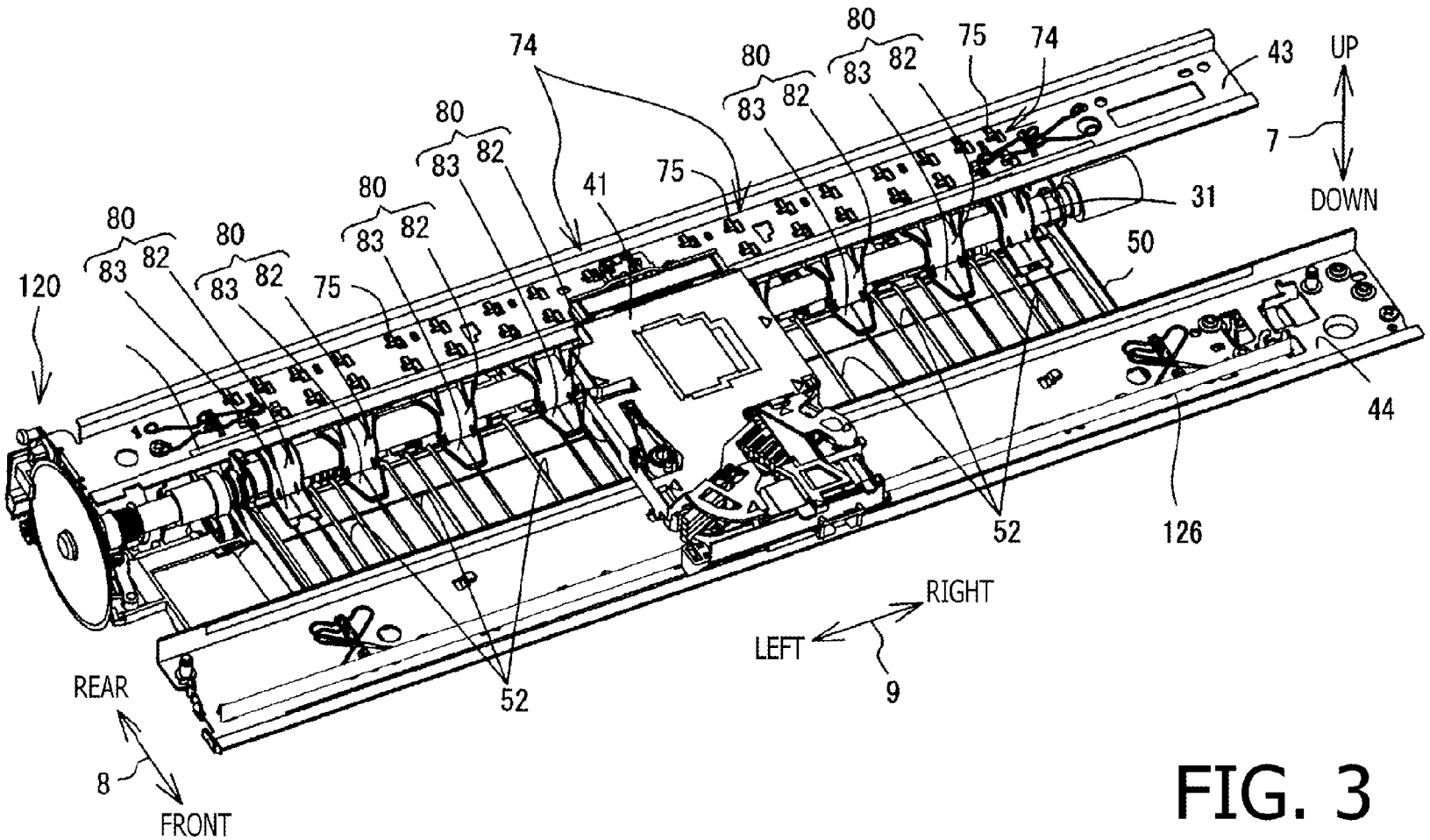
FIG. 3 is a perspective view of a recording unit 40 supported by guide rails 43, 44 in the MFP 10.

As depicted in FIG. 3, the carriage 41 is supported by guide rails 43, 44, which are arranged on a rear side and a front side of the platen 50 respectively. The carriage 41 is slidable to reciprocate along the widthwise direction 9 on the guide rails 43, 44. The carriage 41 is driven to slide on the guide rails 43, 44 by rotation of a carriage motor 103 (see FIG. 6).

[Platen 50]

Figure 4:
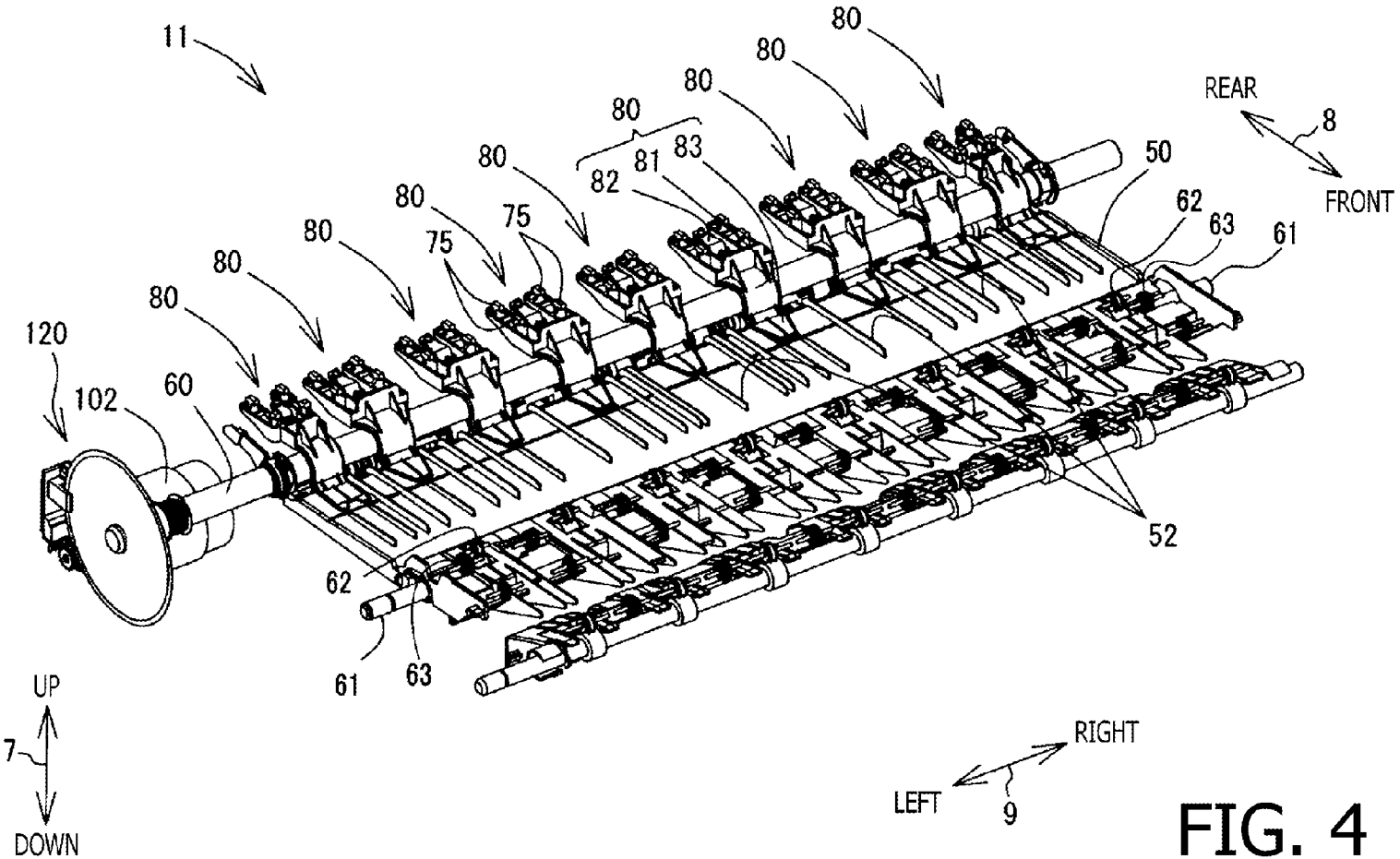
FIG. 4 is a perspective view of contact pieces 80 and a platen 50 in the MFD 10.

As depicted in FIG. 2, a platen 50 is arranged on a downstream side with respect to the conveyer roller unit 30 with regard to the direction of the conveyance flow 19. The platen 50 is arranged to vertically face the recording unit 40 along the vertical direction 7. As depicted in FIGS. 3-5, on an upper plane of the platen 50, a plurality of supporting ribs 52 are formed to protrude upward and extend along the front-rear direction 8. The supporting ribs 52 are formed in positions spaced apart from one another along the widthwise direction 9. The sheet P conveyed by the conveyer roller unit 30 is supported by the platen 50, or, more specifically, by the plurality of ribs 52 formed on the upper plane of the platen 50.

As the carriage 41 moves along the widthwise direction 9, the recording head 42 discharges the ink droplets toward the platen 50. When the sheet P is on the platen 50, therefore, the ink droplets discharged from the recording head 42 land on the sheet P supported by the platen 50. Thus, the recording unit 40 records an image in ink on the sheet P supported by the platen 50.

[Ejection Roller Unit 60]

As depicted in FIG. 2, the ejection roller unit 60 is arranged on a downstream side of the recording unit 40 with regard to the direction of conveyance flow 19. The ejection roller unit 60 includes an ejection roller 61, a spur 62, and a corrugating spur 63. The ejection roller 61 is driven by the conveyer motor 102. The spur 62 is arranged to contact the ejection roller 61. The spur 62 includes a plurality of spurs 62, which are arranged to align along the widthwise direction 9, i.e., along a direction to view FIG. 2 orthogonally. The plurality of spurs 62 are urged against the ejection roller 61 by urging members (not shown), such as springs. Therefore, when the ejection roller 61 rotates, the spurs 62 are rotated along with the rotation of the ejection roller 61. The ejection roller 61 and the spurs 62 nip the sheet P in there-between and convey the sheet P downstream along the direction of the conveyed flow 19. Intensity of a nipping force for the ejection roller unit 60 to nip the sheet P is set to be smaller than intensity of a nipping force for the conveyer roller unit 30 to nip the sheet P. The corrugating spur 63 will be described later in detail.

[Registration Sensor 110]

As depicted in FIG. 2, in an upstream side of the conveyer roller unit 30 with regard to the direction of the conveyance flow 19, a registration sensor 110 is disposed. When the sheet P is in a sensing position, which is for example above the registration sensor 110, the registration sensor 110 detects the sheet P and outputs low-leveled signals. On the other hand, when the sheet P is not in the sensing position, the registration sensor 110 outputs high-leveled signals.

[Rotary Encoder Unit 120]

The printer unit 11 includes a known rotary encoder 120. The rotary encoder unit 120 includes an encoder disk 121 and an encoder sensor 122. As shown in FIGS. 2-4, the encoder disk 121 is disposed on one axial end of the conveyer roller 31. The encoder disk 121 rotates along with rotation of the conveyer roller 31, and the encoder sensor 122 reads the rotating behavior of the encoder disk 121. Thus, the rotary encoder 120 generates pulse signals in accordance with rotation of the conveyer roller 31 and outputs the generated pulse signals to the controller 130.

[Linear Encoder Unit 125]

The MFD 10 includes a linear encoder unit 125, which detects movements of the carriage 41. The linear encoder unit 125 includes an encoder strip 126 and an encoder sensor 127 (see FIG. 6). The encoder strip 126 is a strip stretching along the widthwise direction 9 on the guide rail 44. The encoder sensor 127 is mounted on the carriage 41. When the carriage 41 moves on the guide rails 43, 44, the encoder sensor 127 reads patterns on the encoder strip 126 and generates pulse signals. The generated pulse signals are output to the controller 130.

[Contact Pieces 80]

As depicted in FIG. 2, on an upstream side of the recording head 42 with regard to the direction of the conveyance flow 19, a plurality of contact pieces 80 are arranged in the recording unit 40. The plurality of contact pieces 80 are arranged to be spaced apart from one another along the widthwise direction 9. As depicted in FIGS. 2 and 4, each contact piece 80 includes a fixing portion 81, a curved portion 82, and a contact portion 83.

The fixing portion 81 is fixed to the guide rail 43. In other words, the contact piece 80 is fixed to the guide rail 43 at the fixing portion 81. As depicted in FIG. 4, a plurality of engageable parts 75 are formed to protrude upward from an upper plane of the fixing portion 81. When the engageable parts 75 are engaged with openings 74, which are formed in the guide rail 43, the contact piece 80 is attached to a lower plane of the guide rail 43. As depicted in FIG. 2, the curved portion 82 is formed to extend from the fixing portion 81 and curve lower-frontward toward the downstream of the conveyed flow 19. At the lower-front end of the curved portion 82, the contact portion 83 is formed to protrude frontward.

As depicted in FIG. 2, the contact portion 83 is arranged in a frontward position with respect to the curved portion 82 in the contact piece 80 and is formed to extend frontward from the curved portion 82. The contact portion 83 is arranged to vertically face the platen 50 along the vertical direction 7. An amount of a gap between a lower surface 84 (see FIGS. 2 and 5) of the contact portion 83 and the platen 50 is smaller than an amount of a gap between a bottom plane of the recording head 42 and the platen 50 but is maintained to be substantially large to allow the sheet P to be conveyed in there-between smoothly. Thus, the contact portion 83 is arranged in a position between the carriage 41 and the platen 50 along a direction orthogonal to the direction of the conveyance flow 19 and to the main scanning direction. In other words, the contact portion 83 is arranged in a position between the carriage 41 and the platen 50 along the vertical direction 7.

As depicted in FIG. 5, on the lower surface 84 of the contact portion 83, a contact rib 85 protruding downwardly is formed. While the sheet P is supported by the platen 50 from below, a lower end of the contact rib 85 contacts an upper surface of the sheet P of the sheet P. Thus, the sheet P is pressed downward toward the platen 50 by the contact portion 83 while the image may be formed on the upper surface of the sheet P.

As depicted in FIG. 5, while the plurality of supporting ribs 52 are formed to be spaced apart from one another along the widthwise direction 9, the contact portions 83 of the contact pieces 80 are arranged in between the supporting ribs 52 of the platen 50. Therefore, the supporting ribs 52 protrude toward the carriage 41 at intermediate positions between adjoining contact pieces 80, which are arranged along the widthwise direction 9. In other words, the contact ribs 85 and the supporting ribs 52 are arranged alternately along the widthwise direction 9.

The supporting ribs 52 are, as depicted in FIG. 5, formed to protrude to be higher than the lower ends of the contact ribs 85. More specifically, the supporting ribs 52 contact the sheet P at positions closer to the recording head 42 than contact positions, at which the contact ribs 85 contact the sheet P. When the sheet P is in the position between the platen 50 and the contact portions 83 along the vertical direction 7, and in the position between the conveyer roller unit 30 and the recording head 42 along the direction of the conveyance flow 19, the sheet P is shaped into a corrugated shape waving up and down alternately along the widthwise direction 9 when viewed from an upstream or a downstream position with regard to the conveyance flow 19.

Thus, the contact pieces 80 and the supporting ribs 52 on the platen 50 serve as a corrugation mechanism, which forms the corrugated shape in the sheet P. In particular, the corrugated shape has peaks PA of protrusive mountain portions, protruding from a predetermined reference level, and bottoms PB of recessed valley portions, recessed from the reference level. And each of the peaks PA of protrusive mountain portions and each of the bottoms PB of recessed valley portions are positioned alternately along the widthwise direction 9. More specifically, the peak PA refers to a position of boundary point, at which tendency of the amount of the gap between the recording head 42 and the sheet P along the widthwise direction 9 turns from decreasing to increasing, in the protrusive mountain portion. In other words, the amount of the gap between the recording head 42 and the sheet P increases and decreases alternately along the widthwise direction 9 when the sheet P is at a corrugating position between the conveyer roller unit 30 and the recording head 42. When the sheet P is in between the platen 50 and the contact pieces 80, the positions of the peaks PA substantially coincide with the positions of the supporting ribs 52. The bottom PB refers to a position of a boundary point, at which the tendency of the amount of the gap between the recording head 42 and the sheet P along the widthwise direction 9 turns from increasing to decreasing, in the recessed valley portion. Therefore, when the sheet P is in between the platen 50 and the contact pieces 80, the positions of the bottoms PB substantially coincide with the contact ribs 85. The peaks PA are formed in higher positions with respect to a reference landing position, which will be described later, along the vertical direction 7, and the bottoms PB are formed in lower positions with respect to the reference landing position along the vertical direction 7. Intermediate portions between the peaks PA and the bottoms PB form curves, which can be approximately expressed in a cubic function.

[Corrugating Spurs 63]

The corrugating spur 63 is, as depicted in FIGS. 2 and 4, disposed on a downstream side of the ejection roller unit 60 with regard to the direction of the conveyance flow 19. The corrugating spur 63 includes a plurality of corrugating spurs 63, which are arranged to align along the widthwise direction 9 to be spaced apart from one another. The corrugating spurs 63 are arranged in lower positions than the spurs 62 in the ejection roller unit 60 with regard to height in the vertical direction 7. Therefore, the corrugating spurs 63 are in positions closer to the ejection roller 61 than the spurs 62 with regard to vertical positions along the vertical direction 7. Thus, the corrugating spurs 63 contact the upper surface of the sheet P.

The corrugating spurs 63 are arranged in substantially coincident widthwise positions with the contact pieces 80. In other words, each contact piece 80 and each corrugating spur 63 are arranged in a line along the front-rear direction 9. Therefore, the corrugating spurs 63 contact substantially same areas in the sheet P as the contact pieces 80. In this regard, widthwise positions of the bottoms PB substantially coincide with the widthwise positions of the contact ribs 85 and the corrugating spurs 63. Meanwhile, intensity of force from the corrugating spurs 63 to urge the sheet P is smaller than intensity of force from the contact pieces 80 to urge the sheet P. The difference is made in consideration of that the corrugating spurs 63 contact the upper surface of the sheet P, on which the image is recorded, while the contact pieces 80 contact the upper surface of the sheet P, on which the image is not yet formed. If the force from the corrugating spurs 63 to urge the sheet P is greater, the image recorded on the sheet P may be damaged by the pressure as the sheet P is pressed by the corrugating spurs 63; therefore, in order to maintain quality of the recorded image, the force from the corrugating spurs 63 to urge the sheet P is set to be smaller than intensity of force from the contact pieces 80.

[Controller 130]

As depicted in FIG. 6, the controller 130 includes a CPU (central processing unit) 131, a ROM (read-only memory) 132, a RAM (random access memory) 133, an EEPROM (electrically erasable programmable read-only memory) 134, and an ASIC (application specific integrated circuits) 135, which are connected with one another by internal busses 137.

The ROM 132 stores programs to control behaviors of the CPU 131. The RAM 133 is used as a memory area to temporarily store data and signals to be used in cooperation with the programs stored in the ROM 132 and as a work area to process the data.

In the RAM 133, a plurality of lines of data units containing two (2) bits in each unit, as depicted in FIGS. 11A-11C, are stored. A quantity of pieces of line data to be stored in the RAM 133 is equal to a quantity of nozzles aligned in line along the front-rear direction 8 in the recording head 42; however, in the following description, for the ease of explanation, solely one piece of line data representing the plurality of nozzles will be described. When the line data stored in the RAM 133, the CPU 131 instructs the ASIC 135 to read the line date in the RAM 133. In accordance with the line data read by the ASIC 135, the controller 130 (i.e., the ASIC 135) controls ejection of the ink by manipulating the carriage 41 and the recording head 42.

In the line data shown in FIGS. 11A-11C, a data unit with 2-bit data "00" indicates that no ink droplet should be ejected from the nozzle of the recording head 42. A data unit with 2-bit data "01" indicates that an ink droplet of a smallest size among a plurality of available sizes should be ejected from the nozzle of the recording head 42. A data unit with 2-bit data "10" indicates an ink droplet of a medium size among the available sizes should be ejected from the nozzle of the recording head 42. In this regard, if the size of the ink droplet to be ejected from the recording head 42 should not necessarily be concerned, the line data may contain solely one (1) bit in each unit. In such a case, for example, the data unit with 1-bit data "0" may indicate that no ink droplet should be ejected from the nozzle of the recording head 42, and the data unit with 1-bit data "1" may indicate that an ink droplet should be ejected from the nozzle of the recording head 42.

The EEPROM 134 stores data, such as configuration data and flags, which are to be saved even after power to the controller 130 is shut down. In the EEPROM 134, a reference value D0, peak deviation values Y(m), bottom deviation values Y(m+1), shifting values δ1, δ2, and adjusting values γ are stored. The shifting values δ1 and δ2 may be equivalently referred to as shifted amounts δ1 and δ2 respectively hereinbelow. The reference value D0, the peak deviation values Y(m), the bottom deviation values (Y+1), the shifted amounts δ1, δ2, and the adjusting values γ will be described later in detail.

The ASIC 135 is connected with the conveyer motor 102 and the carriage motor 103. The ASIC 135 obtains driving signals to drive the conveyer motor 102 and the carriage motor 103 from the CPU 131 and outputs driving current to the conveyer motor 102 and the carriage motor 103 according to the driving signals. The conveyer motor 102 and the carriage motor 103 are driven in a normal or reverse rotation by the driving current. For example, the controller 130 may control the conveyer motor 102 to rotate the various rollers. At the same time, the controller 130 may control the carriage motor 103 to reciprocate the carriage 41. Further, the controller 130 may control the recording head 42 to discharge the ink through the nozzles.

The ASIC 135 is electrically connected with the registration sensor 110, the rotary encoder sensor 122 in the rotary encoder unit 120, and the encoder sensor 127 in the linear encoder unit 125. Based on the detected signals output from the registration sensor 110 and the pulse signals output from the encoder sensor 122, the controller 130 detects a position of the sheet P being conveyed. Further, based on the pulse signals obtained from the encoder sensor 127, the controller 130 detects a widthwise position of the carriage 41.

[Control by the Controller 130]

With reference to FIGS. 7-12, a flow of image recording operation conducted by the controller 130 in the MFD 10 will be described herein below. The flow described below may be executed by the CPU 131 reading the software program from the ROM 132 or may be achieved by hardware circuits mounted on the controller 130, or by the hardware circuits cooperating with the software program. The flow of image recording operation described below and illustrated in FIG. 7 may be started by the controller 130 when an image recording instruction to start the operation is inputted by a user.

As the flow shown in FIG. 7 starts, in S10, the controller 130 manipulates the feeder roller 21 to feed the sheet P. In particular, the controller 130 activates the conveyer motor 102 to rotate the feeder roller 21. Thereby, the sheet P is fed by the feeder roller 21 to the conveyer roller unit 30. Next, in S11, when the sheet P reaches the conveyer roller unit 30, the controller 130 manipulates the conveyer roller 31 to convey the sheet P to a recording-start position. In particular, the controller 130 activates the conveyer motor 102 to rotate the conveyer roller 31. The recording-start position refers to a position, at which an area for forming an initial part of the image in the sheet P and the nozzle of the recording head 42 confront each other. The controller 130 may determine that the sheet P reaches the conveyer roller unit 30 and the recording-start position based on composition of the detected signals output from the registration sensor 110 and the pulse signals output from the rotary encoder 120.

Next, if a tail end of the sheet P is not in a position on a downstream side with respect to the conveyer roller unit 30 (S12: NO), in S16, the controller 130 executes a recording step A, in which an image is recorded in a recordable range of the sheet P. The recordable range spreads within a predetermined width along the direction of conveyance flow 19 on the sheet P and corresponds to the area in the sheet P confronting the recording head 42.

Meanwhile, if the tail end of the sheet P is in a position at the downstream side with respect to the conveyer roller unit 30 (S12: YES), the controller 130 executes a flow of combination of steps S13-S17. The steps S13-S17 will be described later in detail. The position of the tail end of the sheet P can be detected by the controller 130, which starts counting the pulse signals from the rotary encoder unit 120 after the signals from the registration sensor 110 change, based on the count of the pulse signals from the rotary encoder unit 120. For example, when the count indicates a smaller value than a value indicating a first distance, which is between a position of the registration sensor 110 and the sheet-nipping position in the conveyer roller unit 30 (S12: NO), that is, when the tail end of the sheet P is in a downstream position with respect to the conveyer roller unit 30, the controller 130 executes the recording step A in S16. For another example, if no change is detected in the signals from the registration sensor 110, it is considered that the tail end of the sheet P is in a position on an upstream side with respect to the conveyer roller unit 30 (S12: NO); therefore, the controller 130 executes the recording step A in S16. Meanwhile, when the count of the pulse signals from the rotary encoder unit 120 indicates a value greater than the value indicating the first distance (S12: YES), the controller 130 executes S13.

In S18, following either S16 or S17, if an entire image for the given image recording instruction is not completely recorded on the sheet P (S18: NO), the flow returns to S11 and repeats the steps following S11. In this regard, in S11, the controller 130 transitively conveys the sheet P in the direction of the conveyance flow 19 for a predetermined linefeed amount. As a result of the linefeed, a new area for forming a next part of the image in the sheet P is placed to confront the nozzle of the recording head 42. Thus, the flow containing combination of steps S11-S18 may be repeated for a plurality of times.

Following S18, when the entire image for the given image recording instruction is completely recorded on the sheet P (S18: YES), in S19, the controller 130 manipulates the ejection roller 61 to eject the sheet P in the ejection tray 15. In particular, the controller 130 manipulates the conveyer motor 102 to rotate for a predetermined amount. Thus, the sheet P is conveyed to the ejection tray 15 and ejected from the MFD 10. Thereafter, the controller 130 terminates the flow. If an image recording instruction for a next sheet P is entered, the controller 130 starts again the flow shown in FIG. 7.

[Recording Process]

The recording process to be conducted by the controller 130 will be described with reference to FIGS. 8-13. The recording process in the present embodiment includes a first correcting step (S14), a second correcting step (S15), the recording step A (S16), and a recording step B (S17). In the present embodiment, a rightward movement of the carriage 41 from a left-hand side toward a right-hand side along the widthwise direction 9 will be referred to as a forward travel or a travel in a forward orientation FWD (see FIG. 8). In the following description, behaviors of the controller 130 with regard to the carriage 41 traveling in the forward orientation FWD will be described. However, the behaviors of the controller 130 with regard to the carriage 41 traveling in a reverse orientation RVS, which is from the right-hand side toward the left-hand side, can be similarly explained by reversing the right and the left.

[Recording Step A]

The recording step A to be conducted by the controller 130 in S16 will be described with reference to FIG. 8. In the MFD 10, when the ink droplet discharged from the recording head 42 is landed at a specific targeted position on the sheet P, it is necessary that the controller 130 controls the recording head 42 to discharge the ink droplet before the recording head 42 reaches a position straight above the targeted position in consideration of time lag required for the discharged ink to travel through the gap between the recording head 42 and the sheet P. Further, it is noted that the sheet P conveyed to the recording-start position in the corrugation mechanism is deformed in the corrugated shape with the peaks PA and the bottoms PB as indicated in a solid line shown in FIG. 8. In other words, as the recording head 42 is moved along the widthwise direction 9, the amount of the gap between the recording head 42 and the sheet P fluctuates to be larger and smaller in the vertical direction 7 alternately. Therefore, it is necessary that the controller 130 adjust the discharging timings of the ink in consideration of the amount of fluctuated gap. For example, the controller 130 adjusts the discharging timing of the ink to be delayed later as the amount of the gap is smaller, and meanwhile, the controller 130 adjusts the discharging timing of the ink to be advanced earlier as the amount of the gap is larger.

Therefore, the controller 130 determines timings to discharge the ink toward a targeted position on each peak PA and each bottom PB on the sheet P respectively in consideration of the amount of gap fluctuation. More specifically, while eight (8) peaks PA and nine (9) bottoms PB are formed in the sheet P, the controller 130 obtains a reference value D0, eight peak deviation values Y(2), Y(4), Y(6), Y(8), Y(10), Y(12), Y(14), Y(16), which correspond to one of the eight peaks PA respectively, and nine bottom deviation values Y(1), Y(3), Y(5), Y(7), Y(9), Y(11), Y(13), Y(15), Y(17), which correspond to one of the nine bottoms PB respectively, from the EEPROM 134. The values to be obtained from the EEPROM 134 may be achieved from experiments and/or simulations and factory-installed in the EEPROM 134 prior to shipping of the MFD 10.

[Reference Value D0]

The reference value D0 indicates a reference timing for the ink to be discharged to land on a reference landing position Ls on the sheet P. More specifically, the reference value D0 indicates a time period, which is required for the ink discharged from the recording head 42 to land on a reference landing position Ls. The reference landing position Ls is set in a center position PC between a mutually adjoining peak PA and bottom PB (i.e., a level of the sheet P when amplitude is zero) along the vertical direction 7, i.e., a direction along which the recording head 42 and the sheet P face each other. Meanwhile, the reference value D0 also corresponds to a time period, which is required by the carriage 41 (more specifically, the recording head 42) to move along the widthwise direction 9 from a reference discharging position Es to a position straight above the reference landing position Ls. Therefore, when the moving velocity of the carriage 41 is expressed by "V", a distance between the reference discharging position Es and the reference landing position Ls along the widthwise direction 9 is expressed as D0*V. In the following description, when the position of the carriage 41 is referred to, it may be interpreted as a position of the recording head 42.

For example, when the carriage 41 traveling in the forward orientation FWD reaches the reference discharging position Es and discharges the ink from the recording head 42 thereat, the ink lands on the reference landing position Ls on the sheet P after D0 second, i.e., after the time period indicated by the reference value D0. Meanwhile, the carriage 41 reaches the position straight above the reference landing position Ls D0 second after the discharge of the ink at the reference discharging position Es. In other words, in order for the discharged ink to land on the reference landing position Ls, the ink should be discharged D0 second before the carriage 41 reaches the position straight above the reference landing position Ls, i.e., when the carriage 41 is at the reference discharging position Es. Thus, the reference value D0 specifies the discharging timing for the ink to be discharged and land on the center position PC (i.e., on the reference landing position Es).

The above-mentioned center position PC may not necessarily be limited to the vertically central position between the mutually adjoining peak PA and bottom PB. For example, the center position PC may be set at an average level between one of the peaks PA closest to the recording head 42 along the vertical direction 7 and one of the bottoms PB farthest from the recording head 42 along the vertical direction 7. For another example, the center position PC may be set at an average level between an average level among levels of the plurality of peaks PA and an average level among levels of the plurality of bottoms PB along the vertical direction 7. The reference value D0 is commonly applied to every targeted position on the sheet P. Meanwhile, the reference value D0 may not necessarily be limited to the example described above but may include, for example, a plurality of reference values. For example, a first reference value, which is used when the discharging timings for the ink to be discharged to land on the peaks PA are determined, and a second reference value, which is used when the discharging timings for the ink to be discharged to land on the bottoms PB are determined, may be included and stored in the EEPROM 134. In such a case, the first reference value may be an average value for the discharging timings to discharge the ink at each one of the peaks PA, and the second reference value may be an average value for the discharging timings to discharge the ink at each one of the bottoms PB.

[Peak Deviation Value Y(m)]

An example, when the recording head 42 discharges the ink at the peak PA on the sheet P, indicated by the solid line in FIG. 8, will be described. While the carriage 41 is moving in the forward orientation FWD along the widthwise direction 9, the recording head 42 targets the ink to land on the peak PA and discharges the ink D0 second before the carriage 41 reaches the position straight above the peak PA at the reference discharging position Es. In this regard, however, the ink lands on an upstream (leftward) position with respect to the peak PA with regard to the forward orientation FWD (rightward) of the carriage 41 along the widthwise direction 9, at a landing position LA1. Thus, a distance a1 between the reference discharging position Es and the landing position LA1 along the widthwise direction 9 is smaller than a distance a (i.e., D0*V) between the reference discharging position Es and the targeted peak PA along the widthwise direction 9 (distance a1<distance a). A deviated amount between the distance a1 and the distance a is represented by the peak deviation value Y(m).

Therefore, it is necessary that the controller 130 manipulates the recording head 42 to discharge the ink targeted at the peak PA at a peak-targeted discharging position Ea (see FIG. 9), which is deviated from the reference discharging position Es upstream with regard to the forward orientation FWD for the amount indicated by the peak deviation value Y(m). Thus, the peak deviation value Y(m) indicates the distance between the reference discharging position Es, at which the recording head 42 should discharge the ink toward the center position PC, and the peak-targeted discharging position Ea, at which the recording head 42 should discharge the ink toward the peak PA, along the widthwise direction 9. Namely, the peak deviation value Y(m), which specifies the discharging timing for the ink to be discharged to land on the peak PA, is obtained by correctly delaying the discharging timing for the ink to be discharged at the center position PC, which is specified by the reference value D0. In other words, the peak deviation value Y(m), which is obtained by correcting the reference discharging position Es, provides the peak-targeted discharging position Ea.

[Bottom Deviation Value Y(m+1)]

An example, when the recording head 42 discharges the ink at the bottom PB on the sheet P, indicated by the solid line in FIG. 8, will be described. While the carriage 41 is moving in the forward orientation FWD along the widthwise direction 9, the recording head 42 targets the ink to land on the bottom PB and discharges the ink D0 second before the carriage 41 reaches the position straight above the bottom PB at the reference discharging position Es. In this regard, however, the ink lands on a downstream (rightward) position with respect to the bottom PB with regard to the forward orientation FWD (rightward) of the carriage 41 along the widthwise direction 9, at a landing position LB 1. Thus, a distance b 1 between the reference discharging position Es and the landing position LB 1 along the widthwise direction 9 is greater than a distance b (i.e., D0*V) between the reference discharging position Es and the targeted bottom PB along the widthwise direction 9 (distance b1>distance b). A deviated amount between the distance b1 and the distance b is represented by the bottom deviation value Y(m+1).

Therefore, it is necessary that the controller 130 manipulates the recording head 42 to discharge the ink targeted at the bottom PB at a bottom-targeted discharging position Eb (see FIG. 9), which is deviated from the reference discharging position Es downstream with regard to the forward orientation FWD for the amount indicated by the bottom deviated amount Y(m+1). Thus, the bottom deviation value Y(m+1) indicates the distance between the reference discharging position Es, at which the recording head 42 should discharge the ink toward the center position PC, and the bottom-targeted discharging position Eb, at which the recording head 42 should discharge the ink toward the bottom PB, along the widthwise direction 9. Namely, the bottom deviation value Y(m+1), which specifies the discharging timing for the ink to be discharged to land on the bottom PB, is obtained by correctly advancing the discharging timing for the ink to be discharged to at the center position PC, which is specified by the reference value D0. In other words, the bottom deviation value Y(m+1), which is obtained by correcting the reference discharging position Es, provides the bottom-targeted discharging position Eb.

[Correction of Discharging Timings by Peak and Bottom Deviation Values]

Therefore, a length of the time required for the carriage 41 to travel the distance corresponding to the peak deviation value Y(m) or the bottom deviation value Y(m+1) is obtained by dividing the peak deviation value Y(m) or the bottom deviation value Y(m+1) by the moving velocity V of the carriage 41. Namely, the discharging timing targeted at the peak PA is expressed as D0+Y(m)/V, and the discharging timing targeted at the bottom PB is expressed as D0+Y(m+1)/V. Thus, by shifting the discharging timing targeted at the peak PA or the bottom PB from the reference value D0, the ink is discharged to land on the targeted peak PA or bottom PB. Having mentioned that, however, in the present embodiment, the peak deviation value Y(m) and the bottom deviation value Y(m+1) divided by the moving velocity V are further multiplied by ½, in consideration of results obtained from experiments and simulations, and added to the reference value D0 respectively.

Accordingly, in the recording step A in S16, the controller 130 manipulates the recording head 42 to discharge the ink to land on the targeted peaks PA at the discharging timings (D0+Y(m)/2V). And the controller 130 manipulates the recording head 42 to discharge the ink to land on the targeted bottoms PB at the discharging timings (D0+Y(m+1)/2V). Thus, the discharging timing for the ink to be discharged to land on the targeted peak PA (i.e., the peak-targeted discharging position Ea) is specified by the combination of the reference value D0, the peak deviation value Y(m), and the moving velocity V of the carriage 41. Meanwhile, the discharging timing for the ink to be discharged to land on the targeted bottom PB (i.e., the bottom-targeted discharging position Eb) is specified by the combination of the reference value D0, the bottom deviation value Y(m+1), and the moving velocity V of the carriage 41.

In this regard, the values D specifying the discharging timings for the targeted peak PA and the targeted bottom PB are represented in an expression D=D0+Y(m)/2V and an expression D=D0+Y(m+1)/2V respectively. In this regard, the value D indicates that the ink is to be discharged D second(s) before the carriage 41 reaches the position straight above the targeted position. Therefore, the greater the value D is, the earlier the discharging timing is advanced to be. Meanwhile, the smaller the value D is, the discharging timing is delayed to be later. Accordingly, when the reference value D0 being a positive value is provided, Y(m)/2V being a negative value, of which absolute value is smaller than the reference value D0, and Y(m+1)/2V being a positive value are achieved.

As mentioned above, the sheet P is deformed to have eight (8) peaks PA and nine (9) bottoms PB. Meanwhile, the EEPROM 134 stores the reference value D0, the eight peak deviation values Y(2), Y(4), Y(6), Y(8), Y(10), Y(12), Y(14), Y(16), which correspond to one of the eight peaks PA respectively, and the nine bottom deviation values Y(1), Y(3), Y(5), Y(7), Y(9), Y(11), Y(13), Y(15), Y(17), which correspond to one of the nine bottoms PB respectively, therein. Further, the EEPROM 134 stores a plurality of adjusting values γ (1) through γ (17). In the present embodiment, when the peak deviation value for one of the peaks PA is represented by a sign Y(m), the bottom deviation value for one of the bottoms PB formed on a neighboring position with respect to the one of the peaks PA is represented by a sign Y(m+1). Moreover, both of the peak deviation value for the peak PA and the bottom deviation value for the bottom PB on an upstream side of the reference position Ps with regard to the forward orientation FWD are represented by the signs Y(m) and Y(m+1) respectively. Meanwhile, both of the peak deviation value for the peak PA and the bottom deviation value for the bottom PB on a downstream side of the reference position Ps with regard to the forward orientation FWD are represented by the signs Y(n) and Y(n+1) respectively.

[Generating Discharge Instructing Signals]

A method to generate discharging timings for the ink to be discharged will be described with reference to FIGS. 9A-9C. The controller 130 generates discharge instructing signals Ss, Sa, Sb for the recording head 42 based on the pulse signals output from the linear encoder unit 125. If the discharging instructing signals Ss, Sa, Sb are generated, the recording head 42 discharges the ink (at the discharging timings Es, Ea, Eb respectively).

First, in a case where the ink is discharged at the center position PC, as shown in FIG. 9A, the controller 130 generates the discharge instructing signal Ss after D0 second from a point, when the carriage 41 is located at a position X (enc). In this regard, the reference value D0 is obtained by the CPU 131 from the EEPROM 134.

Second, in a case where the ink is discharged at the peak PA, the controller 130 adds Y(m)/2V to the reference value D0. More specifically, the CPU 131 reads the reference value D0 and the peak deviation value Y(m) from the EEPROM 134 and obtains the value D0+Y(m)/2. Thus, as shown in FIG. 9B, the controller 130 generates the discharge instructing signal Sa after D0+Y(m)/2V second after the point, when the carriage 41 is located at the position X (enc).

Third, in a case where the ink is discharged at the bottom PB, as shown in FIG. 9C, the controller 130 adds Y(m+1)/2V to the reference value D0. It is noted that, if the bottom deviation value Y(m+1) stored in the EEPROM 134 is a positive value, the value Y(m+1)/2V is subtracted from the reference value D0. More specifically, the CPU 131 reads the reference value D0 and the bottom deviation value Y(m+1) from the EEPROM 134 and obtains Y(m+1)/2V. Thus, as shown in FIG. 9C, the controller 130 generates the discharge instructing signal Sb after D0+Y(m+1)/2V second from the point, when the carriage is located at the position X (enc).

With regard to the moving velocity V of the carriage 41, the CPU 131 may designate one of available velocities from, for example, the ROM 132. For another example, the CPU 131 may obtain information concerning the moving velocity, which is contained in information concerning a resolution of the image, from the image recording instruction.

[First Correcting Step]

The first correcting step to be conducted by the controller 130 in S14 (see FIG. 7) will be described with reference to FIGS. 10A-10F, and 11A-11C. The first correcting step in S14 is performed when the tail end of the sheet P is in a position on a downstream side of the conveyer roller unit 30 with respect to the direction of conveyance flow 19. When the sheet P is conveyed by the conveyer roller unit 30, a surface of the recording sheet to face the recording head 42, i.e., the upper surface, contacts the contact pieces 80 while a surface on the other side, i.e., the lower surface, contacts the supporting ribs 52 (see FIG. 5). In this regard, the sheet P is deformed by the contact pieces 80 and the supporting ribs 52 into a corrugated shape, having the peaks PA and the bottoms PB alternately, which ripples along the widthwise direction 9 (see FIGS. 5 and 8).

A process to convey the sheet P will be described with reference to FIGS. 10A-10F. When the sheet P is fed and conveyed in the sheet-conveying area of the printer unit 11, the sheet P is placed to have a widthwise center Cp thereof to substantially fall on a widthwise center C1 of the sheet-conveying area of the printer unit 11. In the following description, the widthwise center Cp of the sheet P may be referred to as a sheet center Cp, and the widthwise center C1 of the sheet-conveying area of the printer unit 11 may be referred to as a machine center C1. When the sheet P is placed to have the sheet center Cp falling on the machine center C, a roller-caused resultant force produced as a result of rotation of the feed roller 21 and/or the conveyer roller 31 at the widthwise center Cp affects the sheet P at the sheet center C1.

Thus, the sheet P is fed and conveyed by the roller-caused resultant force applied to the sheet center Cp in the sheet P. The state, in which the sheet P is affected by the roller-caused resultant force, is maintained until the sheet P is in contact with the contact pieces 80. In this regard, until the sheet P contacts the contact pieces 80, the sheet center Cp and the machine center C1 may not necessarily coincide with each other. However, for the ease of explanation, the description herein is based on a preferable condition, in which the sheet center Cp and the machine center C1 coincide with each other.

As the sheet P is conveyed further, the sheet P reaches and contacts the contact pieces P. In this regard, parts-caused external force is caused by the contact pieces 80 and the platen 50 at a position deviated from the machine center C1. The parts-caused external force may be caused by, for example, manufacturing variance and/or assembling discordance of the contact pieces 80, unevenness in height of the supporting ribs 52, and/or warp of the platen 50. In other words, the parts-caused external force caused by the contact pieces 80 and the platen 50 may often be created in positions deviated from the machine center C1 and affect the sheet P thereat. In this regard, intensity of the parts-caused external force may be considerably large with respect to the roller-caused resultant force caused by the rotation of the feed roller 21 and/or the conveyer roller 31. And a resultant force from the parts-caused external force and the roller-caused resultant force affects the sheet P being conveyed to deviate the sheet center Cp from the machine center C1. In other words, the resultant force affects the sheet P to be deviated in the widthwise direction 9.

Figure 10A:
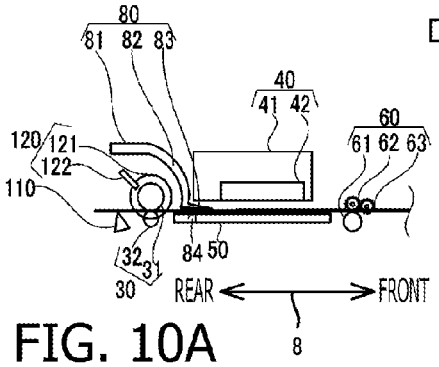
Figure 10B:
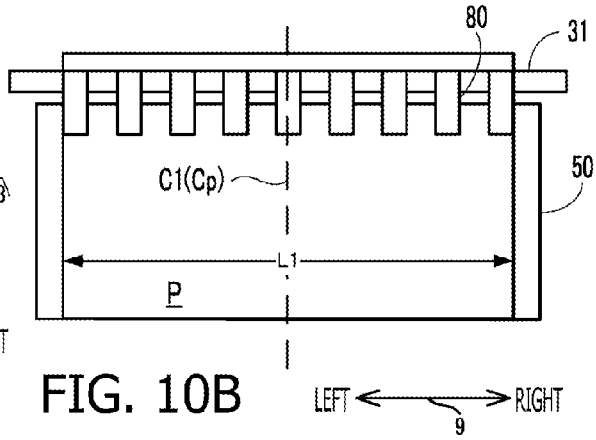

In this regard, when the sheet P is in a nipped condition, that is, when the sheet P is in contact with the contact pieces 80 and is nipped by the conveyer roller unit 30 at the same time, as shown in FIG. 10A, the sheet P is restricted from being deviated by the resultant force in the widthwise direction 9. This is due to intensity of a nipping force to nip the sheet P by the conveyer roller unit 30, which is set to be substantially large to restrict the sheet P from being deviated in the widthwise direction 9. Therefore, as shown in FIG. 10B, the sheet P is placed in a center-aligned position, in which the sheet center Cp coincides with the machine center C1. In this regard, it is noted that, even with the intense nipping force, the sheet P may not completely be prevented from being deviated in the widthwise direction 9 but may be moved to an extent very slightly. However, the description herein is, again, based on the preferable condition.

Figure 10C:
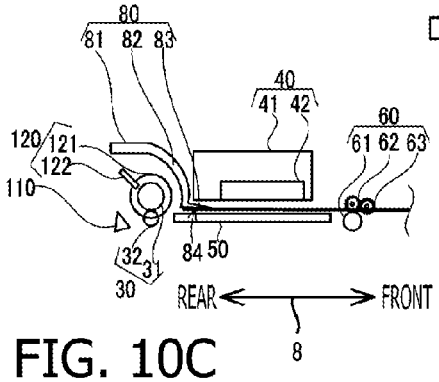
Figure 10D:
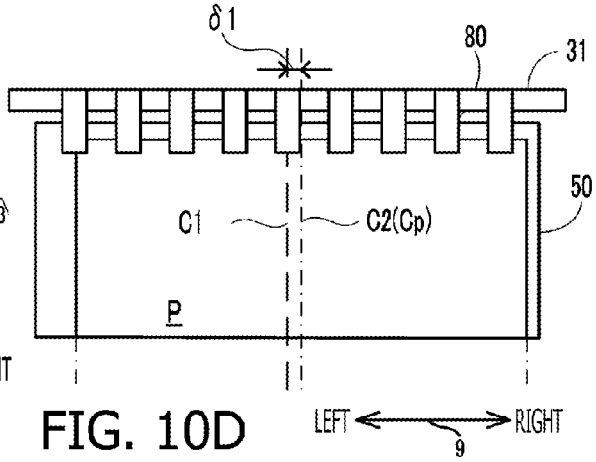

Meanwhile, when the sheet P is in a first non-nipped condition, that is, when the tail end of the sheet P is located in a downstream position from the conveyer roller unit 30 with regard to the direction of conveyance flow 19 while the sheet P is in contact with the contact pieces 80, that is, when the conveyer roller unit 30 does not nip the sheet P, as shown in FIG. 10C, the sheet P is released from the restriction by the nipping force of the conveyer roller unit 30. In this regard, as the sheet P is conveyed for a substantial distance, the sheet center Cp is deviated from the machine center C1 in the widthwise direction 9 for a shifted amount δ1 to a shifted position C2. In other words, in the first non-nipped condition, the sheet center Cp does not coincide with the machine center C1.

Thus, as the sheet P is moved from the nipped condition to the first non-nipped condition, the sheet P is moved in the widthwise direction 9, and the sheet center Cp is shifted to the shifted position C2 from the machine center C1. Due to the difference in the widthwise positions of the sheet P, if the recording head 42 discharges the ink toward the sheet P in the first non-nipped condition at a same position as the recording head 42 discharging the ink toward the sheet P in the nipped condition, the ink tends to land on a different position from a landing position of the ink discharged toward the sheet P in the nipped condition. Accordingly, a quality of the formed image may be impaired depending on the condition of the sheet P.

In order to avoid the impairment of image forming quality, the controller 130 conducts the first correcting step in S14 in the flow shown in FIG. 7, when the tail end of the sheet P is on a downstream side of the conveyer roller unit 30 with respect to the direction of conveyance flow 19 (S12: YES), and when the sheet P is on an upstream side of the contact pieces 80 with respect to the direction of conveyance flow 1 (S13: NO), that is, when the sheet P is in the first non-nipped condition. Therefore, the first correcting step in S14 is performed in order to correct the behavior of the sheet P with the sheet center Cp being shifted to a shifted position C2 from the machine center C1 for the shifted amount δ1 along the widthwise direction 9. The first correcting step in S14 is performed when the count of the pulse signals from the rotary encoder unit 120 is greater than the value corresponding to the first distance and is smaller than a value corresponding to a second distance, which is a distance between the position of the registration sensor 110 and a most downstream position in the contact portions 83 of the contact pieces 80 along the direction of the conveyance flow 19. In the following description, the first correcting step (S14) related to the sheet P in the first non-nipped condition will be described in comparison with the sheet P in the nipped condition, wherein the tail end of the sheet P is on an upstream side of the conveyer roller unit 30.

According to the present embodiment, in order for the recording head 42 to discharge the ink at predetermined discharging timings, a starting position register (not shown) is prepared in the ASIC 135 in the controller 130. The starting position register is prepared to store information concerning a starting position for the carriage 41 to be placed. According to the present embodiment, once the carriage 41 is moved, a first droplet of the ink since the movement is discharged from the recording head 42 in response to the carriage 41 being placed in the starting position and after a predetermined time period from the placement of the recording head 42 in the starting position. Further, an initial discharge register is prepared in the ASIC 135. The initial discharge register is prepared to store initial discharging data. The initial discharging data indicates the data unit to be used by the recording head 42 to discharge the first droplet after the predetermined time period since the carriage 41 starts being moved from the starting position.

As shown in FIGS. 11A-11C, a line of data being image data, which contains a series of 2-bit data units, is stored in the RAM 133. FIGS. 11A-11C show an example, in which a head data unit containing "01" is stored in a specific memory area having an address 50, and succeeding data units, e.g., second, third, and succeeding data units ("10", "11", etc.), are stored in areas with succeeding addresses, e.g., 51, 52, etc., respectively. The line data in the RAM 133 is read by the ASIC 135 upon a reading instruction from the CPU 131. The reading instruction concerning the reading of the line data differs depending on the condition of the sheet P among the nipped condition, the first non-nipped condition, and a second non-nipped condition, which will be described later. In the following description, therefore, the difference of the reading instruction among the conditions will be explained.

In this paragraph, reading the line data in the RAM 133 by the ASIC 135 by the CPU 131, in a case where the sheet P is in the nipped condition, will be described. When the CPU 131 instructs the ASIC 135 to read the line data in the RAM 133, the CPU 131 sets information in the head data unit, which is contained at the address 50, in the initial discharge register in the ASIC 135. Thereafter, the CPU 131 sets information indicating, for example, a position 100 enc in the starting position register in the ASIC 135 as the starting position. With these pieces of information in the registers, once the carriage 41 is placed at the starting position indicated by the starting position register (i.e., 100 enc), the ASIC 135 manipulates the recording head 42 to discharge the first ink droplet at the targeted position according to the information in the data unit registered in the initial discharge register, i.e., "01" in the leftmost memory area in the line data at the address 50. In this regard, the ASIC 135 supplies information concerning a position of the targeted position within the corrugated shape of the recording sheet. Based on the given information, if the targeted position of the discharged ink droplet should fall on the center position PC within the corrugated shape of the sheet P, the recording head 42 discharges the ink droplet indicated by the head data unit at the head address 50 at D0 second after the starting point, i.e., D0 second after the carriage 41 is placed at the starting position (i.e., 100 enc). Meanwhile, if the targeted position of the ink droplet should fall on the peak position PA in the corrugated sheet P, the recording head 42 discharges the ink droplet at D0+Y(m)/2V second after the starting point. If the targeted position of the ink should droplet fall on the bottom position PB in the corrugated sheet P, the recording head 42 discharges the ink droplet at D0+Y(m+1)/2V second after the starting point. Once the first droplet is discharged from the recording head 42 based on the information set in the starting position register and the initial discharge register, the ink is discharged according to the succeeding data units in the line data and according to the positions of the targeted positions within the corrugated shape of the recording sheet.

Next, reading the line data in the RAM 133 by the ASIC 135 by the CPU 131, in a case where the sheet P is in the first non-nipped condition, will be described. When the CPU 131 instructs the ASIC 135 to read the line data in the RAM 133, the CPU 131 sets the information in the head data unit, which is contained in the address 50, in the initial discharge register in the ASIC 135. Thereafter, the CPU 131 sets information indicating a position, which is shifted from the position 100 enc for the shifted amount δ1, in the starting position register in the ASIC 135 as the starting position. The shifted amount δ1 is stored in the EEPROM 134 and is read by the CPU 131 upon the instruction. For example, the shifted amount δ1 may be a value corresponding to 2 enc. In other words, information indicating the position 102 enc is set as the starting position. With these pieces of information, once the carriage 41 is placed at the starting position indicated by the starting position register (i.e., 102 enc), the ASIC 135 manipulates the recording head 42 to discharge the first ink droplet at the targeted position according to the information in the data unit registered in the discharge register, i.e., "01" in the leftmost memory area in the line data at the address 50. Thus, by shifting the starting position for the shifted amount δ1 (i.e., from 100 enc to 102 enc), once the carriage 41 is placed at the starting position (102 enc), and according to the information concerning the position in the corrugated shape of the sheet P, on which the ink droplet discharged according to the data unit at the head address 50 should land, the recording head 42 is manipulated to discharge the first ink droplet at the targeted position.

Following the first correcting step in S14, in S16, the controller 130 executes the recording step A described previously.

Accordingly, when the sheet P is in the first non-nipped condition, and in response to the carriage 41 being placed in a corrected starting position (i.e., 102 enc), which is shifted from the initial discharging position (i.e., 100 enc) for the shifted amount δ1, the controller 130 manipulates the recording head 42 to discharge the ink. The shifted amount δ1 is equivalent to an amount for the sheet P to be moved in the widthwise direction 9 when the conditions of the sheet P changes from the nipped condition to the first non-nipped condition. Thus, the impairment of image forming quality due to the discharged ink droplets landing on deviated positions with respect to targeted positions may be restrained.

[Second Correcting Step]

Next, the second correcting step to be conducted by the controller 130 in S15 (see FIG. 7) will be described with reference to FIGS. 10A-10F and 11A-11C. The second correcting step in S15 is executed when the tail end of the sheet P is on a downstream side of the contact pieces 80 with respect to the direction of conveyance flow 19. Below will be explained the second correcting step on basis of positions of the sheet P, which is moved in the conveyance flow 19.

When the sheet P is in contact with the contact pieces 80 and is nipped by the conveyer roller unit 30, i.e., when the sheet P is in the nipped condition, as shown in FIG. 10B, the sheet P is placed in the center-aligned position, in which the sheet center Cp coincides with the machine center C1. As the sheet P is conveyed further, the tail end of the sheet P comes to a position on a downstream side with respect to the conveyer roller 31, and the sheet P is placed in a condition to contact the contact pieces 80, i.e., in the first non-nipped condition. When the sheet P is in the first non-nipped condition, as mentioned above, the sheet center Cp is shifted from the machine center C1 to the shifted position C2 (see FIG. 10D). In other words, the sheet P is moved in the widthwise direction 9.

Figure 10E:
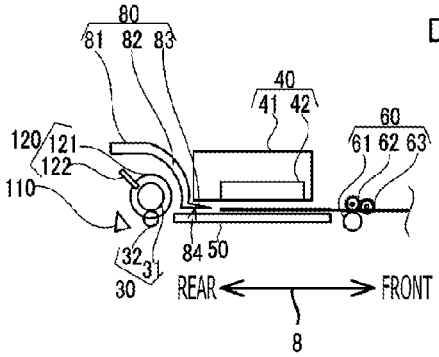

As the sheet P is conveyed further from the first non-nipped condition, as shown in FIG. 10E, the sheet P is placed in a second non-nipped condition, in which the tail end of the sheet P is in a position on a downstream side of the contact pieces 80. Under this condition, the sheet P is not nipped by the conveyer roller unit 30 and also released from the pressure from the contact pieces 80. In other words, when the sheet P is in the second non-nipped condition, the sheet P is not affected by the pressure from the contact pieces 80. Meanwhile, the sheet P continues being affected by the pressure from the corrugating spurs 63. In this regard, as mentioned above, each contact piece 80 and each corrugating spur 63 are arranged in a line along the front-rear direction 9. Therefore, the corrugating spurs 63 contact substantially same areas in the sheet P as the contact pieces 80. In this regard, however, the parts-caused external force may be caused by the corrugating spurs 63 and the platen 50 at a position deviated from the machine center C1. The parts-caused external force may be due to, for example, manufacturing variance and/or assembling discordance of the corrugating spurs 63, unevenness in height of the supporting ribs 52, and/or warp of the platen 50.

Meanwhile, the sheet P may also be affected by pullback external force, by which the sheet P tends to maintain the forms of the bottoms PB, from the corrugating spurs 63 and the platen 50. The pullback external force tends to pull the sheet P so that the sheet center Cp is placed back in the position of the machine center C1. Therefore, while the sheet P tends to place the sheet center Cp on the machine center C1 due to the pullback external force, with the parts-caused external force being caused at the positions deviated from the machine center C1, the sheet P is restricted from moving the sheet center Cp back on the machine center C1. As a result, however, a resultant force from the pullback external force and the parts-caused external force and the roller-caused resultant force affect the sheet P to tend to move the sheet center Cp toward the machine center C1. It is noted that the roller-caused resultant force is generated when the ejection roller 61 rotates. In other words, the resultant force affects the sheet P to be moved in the widthwise direction 9.

Thus, while the sheet P is conveyed, the sheet center Cp is moved to a shifted position C3, which is shifted from the machine center C1 for a shifted amount δ2 along the widthwise direction 9, by the resultant force. In this regard, the shifted position C3 is in a position between the machine center C1 and the shifted position C2. In other words, the condition, in which the sheet center Cp does not coincide with the machine center C1, is maintained.

Thus, as conditions of the sheet P are changed from the nipped condition to the second non-nipped condition, the sheet P is moved in the widthwise direction 9, and the sheet center Cp is shifted for the shifted amount δ2 to the shifted position C3 from the machine center C1. In other words, the sheet P is moved along the widthwise direction 9. Due to the difference in the widthwise positions of the sheet P, if the recording head 42 discharges the ink toward the sheet P in the second non-nipped condition at a same position as the recording head 42 discharging the ink toward the sheet P in the nipped condition, the ink tends to land on a different position from a landing position of the ink discharged toward the sheet P in the nipped condition. Accordingly, a quality of the formed image may be impaired depending on the condition of the sheet P.

In order to avoid the impairment of image forming quality, the controller 130 conducts the second correcting step in S15 in the flow shown in FIG. 7, when the tail end of the sheet P is in a position on a downstream side with respect to the conveyer roller unit 30 (S12: YES), and when the sheet P is in a position on a downstream side with respect to the contact pieces 80 (S13: YES), that is, when the sheet P is in the second non-nipped condition. Therefore, the second correcting step in S15 is performed in order to correct the behavior of the sheet P with the sheet center Cp being shifted to a shifted position C3 from the machine center C1 for the shifted amount δ2 along the widthwise direction 9. The second correcting step in S15 is performed when the count of the pulse signals from the rotary encoder unit 120 is smaller than the value corresponding to the second distance.

Next, reading the line data in the RAM 133 by the ASIC 135 by the CPU 131, in a case where the sheet P is in the second non-nipped condition, will be described. When the CPU 131 instructs the ASIC 135 to read the line data in RAM 133, the CPU 131 sets the information in the head data unit, which is contained in the address 50, in the initial discharge register in the ASIC 135. Thereafter, the CPU 131 sets information indicating a position, which is shifted from the position 100 enc for the shifted amount δ2, in the starting position register in the ASIC 135 as the starting position. The shifted amount δ2 is stored in the EEPROM 134 and is read by the CPU 131 upon the instruction. For example, the shifted amount δ2 may be a value corresponding to 1 enc. In other words, information indicating the position 101 enc is set as the starting position. With these pieces of information, once the carriage 41 is placed at the starting position indicated by the starting position register (i.e., 101 enc), the ASIC 135 manipulates the recording head 42 to discharge the first ink droplet at the targeted position according to the information in the data unit registered in the discharge register, i.e., "01" in the leftmost memory area in the line data at the address 50. Thus, by shifting the starting position for the shifted amount δ2 (i.e., from 100 enc to 101 enc), once the carriage 41 is placed at the starting position (101 enc), and according to the information concerning the position in the corrugated shape of the sheet P, on which the ink droplet discharged according to the data unit at the head address 50 should land, the recording head 42 is manipulated to discharge the first ink droplet at the targeted position.

Accordingly, when the sheet P is in the second non-nipped condition, and on condition that the carriage 41 is placed in a corrected starting position (i.e., 101 enc), which is shifted from the initial discharging position (i.e., 100 enc) for the shifted amount δ2, the controller 130 manipulates the recording head 42 to discharge the ink. The shifted amount δ2 is equivalent to an amount for the sheet P to be moved in the widthwise direction 9 when the conditions of the sheet P changes from the nipped condition to the second non-nipped condition. Thus, the impairment of image forming quality due to the discharged ink droplets landing on deviated positions with respect to targeted positions may be restrained.

[Recording Step B]

Figure 10F:
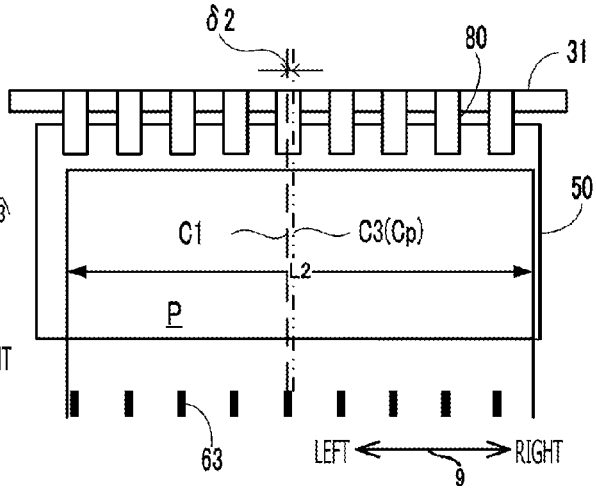

The recording step B to be conducted by the controller 130 in S17 will be described with reference to FIGS. 10A-10F and 12. While the sheet P in the second non-nipped condition is released from the pressure of the contact pieces 80, as shown in FIG. 10F, the sheet P tends to stretch in the widthwise direction 9 with widthwise ends thereof separating apart from each other. In this regard, while a distance between the widthwise ends of the sheet P in the nipped condition is represented by L1 (see FIG. 10B), and a distance between the widthwise ends of the sheet P in the second non-nipped condition is represented by L2 (see FIG. 10F), the distance L2 is greater than the distance L1 (L2>L1).

Therefore, when the conditions of the sheet P change from the nipped condition to the second non-nipped condition, the widthwise ends of the sheet P tend to be separated away from the sheet center Cp. In particular, as shown in a lower row in FIG. 12, peaks PA' and bottoms PB', excluding the bottom PB' at a reference position Ps on a dash-and-dot line shown in FIG. 12, are shifted along the widthwise direction 9 to positions displaced away from the peaks PA and the bottoms PB shown in an upper row in FIG. 12 respectively. In this regard, amounts for the peaks PA' and the bottoms PB' to be displaced with respect to the corresponding peaks PA and the bottoms PB are enlarged to be greater as the peaks PA' and the bottoms PB' are farther from the reference position Ps. In other words, the peaks PA' and the bottoms PB' in upstream positions with respect to the reference position Pa with regard to the forward orientation FWD are displaced to the farther upstream positions with respect to the corresponding peaks PA and the bottoms PB respectively, and the farther the peaks PA' and the bottoms PB' are apart from the reference position Ps, the greater the displaced amounts for the peaks PA' and the bottoms PB' are enlarged from the corresponding peaks PA and the bottoms PB respectively. Meanwhile, the peaks PA' and the bottoms PB' in downstream positions with respect to the reference position Pa with regard to the forward orientation FWD are displaced to the farther downstream positions with respect to the corresponding peaks PA and the bottoms PB respectively, and the farther the peaks PA' and the bottoms PB' are apart from the reference position Ps, the greater the displaced amounts for the peaks PA' and the bottoms PB' are enlarged from the corresponding peaks PA and the bottoms PB respectively.

Thus, if the recording head 42 discharges the ink toward the sheet P in the second non-nipped condition at a same position as the recording head 42 discharging the ink toward the sheet P in the nipped condition in the recording step A (S16), the ink tends to land on a different position from a landing position of the ink discharged toward the sheet P in the nipped condition. Accordingly, a quality of the formed image may be impaired depending on the conditions of the sheet P. In order to avoid the impairment of image forming quality, the controller 130 executes the second correcting step in S15 in the flow shown in FIG. 7, and executes the recording step B (S17) thereafter. Therefore, the recording step B in S17 is performed in order to correct the behavior of the sheet P with the widthwise ends thereof being moved apart from the sheet center Cp.

In this regard, it is necessary that the recording head 42 discharges the ink toward the peak PA' on the sheet P at a corrected peak-targeted discharging position Ea' (see FIG. 12), which is displaced from the peak-targeted discharging position Ea in a direction to be away from the reference position Ps, and that the recording head 42 discharges the ink toward the bottom PB' on the sheet P at a corrected bottom-targeted discharging position Eb' (see FIG. 12), which is displaced from the bottom-targeted discharging position Eb in the direction to be away from the reference position Ps. In order to correct the peak-targeted discharging position Ea into the corrected peak-targeted discharging position Ea' and the bottom-targeted discharging position Eb into the corrected bottom-targeted discharging position Eb', an adjusting value γ is applied.

The EEPROM 134 stores a plurality of adjusting values γ (1)-γ (17), which are used to correct the peak deviation value Y(m) for each peak PA and the bottom deviation value Y(m+1) for each bottom PB. In FIG. 12, the deviation values Y and the adjusting value γ associated with one another are indicated by same reference numerals placed in parentheses. The adjusting value γ is a value, which affects the peak deviation value Y(m) and the bottom deviation value Y(m+1) to be decreased, for a greater amount as the peak PA' and the bottom PB' are located in farther positions apart from the reference position Ps toward the upstream side with regard to the forward orientation FWD; and affects the peak deviation value Y(m) and the bottom deviation value Y(m+1) to be increased, for a greater amount as the peak PA' and the bottom PB' are located in farther positions apart from the reference position Ps toward the downstream side with regard to the forward orientation FWD. In particular, with regard to the adjusting values γ (1) through γ (8), which are values to be applied to the peaks PA' and the bottoms PB' formed on the upstream side with respect to the reference position Ps with regard to the forward orientation FWD, the farther the peaks PA' and bottoms PB' are apart from the reference position Ps, the smaller adjusting values γ (1)-(8) are applied to the peak adjusting values Y(m) and the bottom adjusting values Y(m+1). In this regard, the adjusting values γ (1)-(8) are smaller than or equal to zero (0). Meanwhile, with regard to the adjusting values γ (10) through γ (17), which are values to be applied to the peaks PA' and the bottoms PB' formed on the downstream side with respect to the reference position Ps with regard to the forward orientation FWD, the farther the peaks PA' and bottoms PB' are apart from the reference position Ps, the larger adjusting values γ (10)-(17) are applied to the peak adjusting values Y(m) and the bottom adjusting values Y(m+1). In this regard, the adjusting values γ(10)-(17) are larger than or equal to zero (0). Meanwhile, the adjusting value γ(9) corresponding to the reference position Ps is zero (0). Largeness or smallness of the adjusting values γ (1)-(17) can be expressed in an inequality: γ (1)≤γ (2)≤γ (3)≤γ (4)≤γ (5)≤γ (6)≤γ (7)≤γ (8)≤γ (9)≤γ (10)≤γ (11)≤γ (12)≤γ (13)≤γ (14)≤γ (15)≤γ (16)≤γ (17). In the present embodiment, the adjusting values γ, which are used to adjust the peak deviation values (Y) and the bottom deviation values Y(m+1) for the peaks PA' and the bottoms PB' formed on the upstream side of the reference position Ps with regard to the forward orientation FWD may be represented by γ(m); and the adjusting values γ, which are used to adjust the peak deviation values (Y) and the bottom deviation values Y(m+1) for the peaks PA' and the bottoms PB' formed on the downstream side of the reference position Ps with regard to the forward orientation FWD may be represented by γ(n).

The discharging timings for the recording head 42 to discharge the ink in the recording step B in S17 are obtained by adjusting the peak deviation values Y(m) and the bottom deviation values Y(m+1), which are adjusted by applying the adjusting value γ and deviating the adjusted peak deviation values Y(m) and the bottom deviation values Y(m+1) from the reference value D0 respectively. In particular, the peak deviation values Y(m) and the bottom deviation values Y(m+1) are adjusted by adding the adjusting values γ. Therefore, in the recording step B in S17, the discharging timings are obtained by dividing the adjusted peak deviation values Y(m) and the adjusted bottom deviation values Y(m+1) by the moving velocity V of the carriage 41, multiplying the divided value by ½, and adding the multiplied value to the reference value D0.

Thus, in the recording step B in S17, the discharging timings to discharge the ink toward the peaks PA' formed on the upstream side of the reference position Ps with regard to the forward orientation FWD, i.e., the corrected peak-targeted discharging positions Ea', are expressed as D0+(Y(m)+γ(m))/2V; and the discharging timings to discharge the ink toward the bottoms PB' formed on the upstream side of the reference position Ps with regard to the forward orientation FWD, i.e., the corrected bottom-targeted discharging positions Eb', are expressed as D0+(Y(m+1)+γ(m+1))/2V. Meanwhile, the discharging timings to discharge the ink toward the peaks PA' formed on the downstream side of the reference position Ps with regard to the forward orientation FWD, i.e., the corrected peak-targeted discharging positions Ea', are expressed as D0+(Y(n)+γ(n))/2V; and the discharging timings to discharge the ink toward the bottoms PB' formed on the downstream side of the reference position Ps with regard to the forward orientation FWD, i.e., the corrected bottom-targeted discharging positions Eb', are expressed as D0+(Y(n+1)+γ(n+1))/2V.

Therefore, the controller 130 manipulates the recording head 42 to discharge the ink toward the peaks PA' formed on the upstream side of the reference position Ps with regard to the forward orientation FWD at the discharging timings D0+(Y(m)+γ(m))/2V, and toward the bottoms PB' formed on the upstream side of the reference position Ps with regard to the forward orientation FWD at the discharging timings D0+(Y(m+1)+γ(m+1))/2V. Meanwhile, the controller 130 manipulates the recording head 42 to discharge the ink toward the peaks PA' formed on the downstream side of the reference position Ps with regard to the forward orientation FWD at the discharging timings D0+(Y(n)+γ(n))/2V, and toward the bottoms PB' formed on the downstream side of the reference position Ps with regard to the forward orientation FWD at the discharging timings D0+(Y(n+1)+γ(n+1))/2V.

Thus, the expressions D0+(Y(m)+γ(m))/2V, D0+(Y(m+1)+γ(m+1))/2V, D0+(Y(n)+γ(n))/2V, and D0+(Y(n+1)+γ(n+1))/2V represent the discharging timings. The reference value D0; the peak deviation values Y(m), Y(n); the adjusting values γ (m), γ(n); and the moving velocity V of the carriage 41 are used to obtain the discharging timings (i.e., the corrected peak-targeted discharging positions Ea') to discharge the ink so that the ink should land on the peaks PA'. The reference value D0; the peak deviation values Y(m+1), Y(n+1); the adjusting values γ(m+1), γ(n+1); and the moving velocity V of the carriage 41 are used to obtain the discharging timings (i.e., the corrected bottom-targeted discharging positions Eb') to discharge the ink so that the ink should land on the bottoms PB'.

[Discharging Timings for Transitional Positions]

In the recording step A in S16, meanwhile, the controller 130 calculates first discharging timings to discharge the ink at transitional positions between each peak PA and bottom PB and manipulates the recording head 42 to discharge the ink toward the transitional positions at the calculated first discharging timings. The first discharging timings for the transitional positions are obtained based on the peak deviation value Y(m), which is a peak deviation value Y(m) for one of the peaks PA closest to the transitional position along the widthwise direction 9, and the bottom deviation value Y(m+1), which is a bottom deviation value Y(m+1) for one of the bottoms PB closest to the transitional position along the widthwise direction 9. Further, an interpolating expression 1 described below and the reference value D0 are used for the calculation.

More specifically, the controller 130 fills the interpolating expression 1 with values (x, c) which identify the transitional position, the peak deviation value Y(m) of the peak PA closest to the transitional position, and the bottom deviation value Y(m+1) of the bottom PB closest to the transitional position. Thereby, a deviation value y', which indicates a deviated amount between the targeted transitional position and a landing position for the ink discharged D0 second(s) before the carriage 41 reaches a position straight above the targeted transitional position along the widthwise direction 9, is calculated. Thereafter, the controller 130 fills expression 2 described below with the deviation value y' and the reference value D0. Thus, the discharging timing to discharge the ink toward the targeted transitional position is obtained. The controller 130 repeats the calculations for all the transitional positions in between each peak PA and bottom PB.

$$y' = -\frac{1}{L^3}(Y_{(m+1)} - Y_{(m)})(x + c - X_{(m)})^2\{2(x + c - X_{(m)}) - 3L\} + Y_{(m)} \quad \text{[Expression 1]}$$

$$D_{(x)} = \frac{y'}{2V} + D_0 \quad \text{[Expression 2]}$$

The value x in the expression 1 identifies a position of the carriage 41 and is determined based on the pulse signals from the linear encoder 125. The value c in the expression 1 indicates a distance between a nozzle, of which discharging timing is being calculated, and a widthwise center of the recording head 42. The value X(m) in the expression 1 indicates the positions of the peak PA and the bottom PB closest to the transitional position and is determined based on the pulse signals from the linear encoder unit 125. The value L in the expression 1 indicates a distance between the peak PA and the bottom PB closest to the transitional position and is expressed as L=X(m+1)−X(m). The value V in the expression 2 indicates the moving velocity of the carriage 41.

In the recording step B in S17, on the other hand, the controller 130 fills the interpolating expression with the adjusted peak deviation values (Y(m)+γ(m)) instead of the peak deviation values Y(m) and the adjusted bottom deviation values (Y(m+1)+γ(m+1)) instead of the bottom deviation values Y(m+1) respectively to obtain the discharging timings for the transitional positions. Thus, the controller 130 manipulates the recording head 42 to discharge the ink toward transitional positions in the sheet P at the calculated discharging timings.

In the present embodiment, the adjusting values γ(1) through γ(17) are stored in the EEPROM 134; however, the adjusting values γ(1) through γ(17) may not necessarily be stored in the EEPROM 134. For example, the controller 130 may be equipped with a calculating means to calculate a linear equation Y'=Y+(X(m)−X(c))C. The calculating means may be, for example, achieved by the controller 130 executing a software program or by a hardware circuits cooperating with the software program. In other words, the controller 130 may adjust the values Y, i.e., Y(m), Y(m+1), by the above-mentioned linear equation expressed by Y'.

It is noted that the value Y mentioned above represents the deviation values including the peak deviation values Y(m) and the bottom deviation values Y(m+1). The values X(m) represent values, which identify the positions of the peaks PA and the bottoms PB and are determined based on the pulse signals from the linear encoder unit 125. The value X(c) represents a position of the bottom PB, which is at the widthwise center on the widthwise direction 9, among the plurality of bottoms PB. In other words, the value X(c) represents a position of the supporting rib 52, which is at the widthwise center on the widthwise direction 9, among the plurality of supporting ribs 52. These values X(m) and X(c) may be stored in the ROM 131 or in the EEPROM 134. The value C represents an inclination of the linear equation represented by Y'. The inclination C may vary in each MFD 10 and is stored in the EEPROM 134.

For example, in order to adjust the peak deviation value Y(2), the controller 130 obtains the peak deviation value Y(2) and the inclination C from the EEPROM 134 and the value X(2) and X(c) from the ROM 131 or the EEPROM 134. The controller 130 fills the linear equation with the obtained Y(2), C, X(2), and X(c) to calculate Y'(2). In this regard, if, for example, the recording head 42 on the carriage 41 moving in the forward orientation FWD discharges the ink at the position X(2), i.e., a position above the peak PA(2), the discharged ink lands on a downstream side of the peak PA(2) with regard to the forward orientation FWD. Therefore, it is necessary that the controller 130 calculates the value Y'(2) so that the ink should be discharged from the recording head 42 on the carriage 41 moving in the forward orientation FWD in an upstream position with respect to the position X(2) for a predetermined distance. Thus, when the recording head 42 discharges the ink at the discharging timing indicated by Y'(2), the discharged ink lands on the peak PA(2). The controller 130 may obtain the value Y' for each point before the carriage 41 starts moving in the forward orientation FWD.

According to the embodiment described above, thus, when the ink is discharged at the sheet P in the second non-nipped condition, in which the sheet P is stretched along the widthwise direction 9 (see FIG. 10BF), the discharging timings are advanced to be earlier while the targeted positions are on the upstream side of the reference position Ps with regard to the forward orientation FWD, and the discharging timings are delayed to be later while the targeted positions are on the downstream side of the reference position Ps with regard to the forward orientation FWD. Accordingly, the deviation of the inks can be suppressed throughout the width of the sheet P.

[More Examples]

In the embodiment described above, the controller 130 executes the recording step B (S17) after executing the second correcting step (S15); however, the flow may not necessarily be conducted in this order. For example, in the second non-nipped condition, if the sheet P is not stretched to be wider substantially in the widthwise direction 9 compared to the sheet P in the nipped condition, if the stretched amount of the sheet P in the second non-nipped condition in the widthwise direction 9 is so small that the landing positions on the sheet P are substantially not influenced by the stretch, the controller 130 may execute the recording step A (S16) after executing the second correcting step (S15).

In the embodiment described above, in order to suppress the impairment of the image forming quality, which is due to the widthwise moving behavior of the sheet P, the controller 130 sets the starting position register in the ASIC 135 in a position shifted from the initial discharging position for the shifted amount δ1 or δ2. However, the method to suppress the impairment of the image forming quality due to the widthwise moving behavior of the sheet P may not necessarily be limited to the one described above.

For example, in the case where the conditions of the sheet P change from the nipped condition to the first non-nipped condition, when the line data being the image data is stored in the RAM 133, the controller 130 may store units of mask data "00" in front of the head address "01," e.g., at addresses 48 and 49. Alternatively, throughout the nipped condition and the first non-nipped condition, the position to be set in the starting position register may be maintained unchanged, while the data unit to be set in the initial discharge register may be changed from the one in the address 50 to the one in the address 48.

For another example, when the line data is stored in the RAM 133, two units of mask data "00", "00" may be added to the line data to form a new line data, and the new line data with the added mask data may be stored in the RAM 133. Thereby, when the new line data is stored in the RAM 133, the added data units "00", "00" are stored in the addresses 50 and 51 respectively, and the data unit "01", which was at the head in the former line data, is stored in the address 52. In this regard, throughout the nipped condition and the first non-nipped condition, the position to be set in the starting position register may be maintained unchanged, and the addresses to be set in the initial discharge register may also be maintained unchanged. In this regard, it is noted that data unit of mask data "00" indicates that no ink droplet should be ejected from the recording head 42.

What is claimed is:

1. An inkjet printer comprising:

a conveyer comprising a conveyer roller unit, the conveyer roller unit being configured to nip a sheet and convey the sheet along a conveyance direction;

a recording head configured to discharge ink toward the sheet conveyed by the conveyer;

a carriage mounting the recording head thereon and configured to move along a scanning direction;

a corrugation mechanism configured to shape the sheet into a corrugated shape, in which an amount of a gap between the recording head and the sheet is increased and decreased alternately along the scanning direction, at a corrugating position between the conveyer roller unit and the recording head; and a controller configured to execute an operation comprising:

a conveying step, in which the sheet is conveyed by the conveyer; and a recording step, in which the carriage is moved and the recording head is manipulated to discharge ink toward the sheet, wherein the recording step comprises:

a discharging step, in which the recording head is manipulated to discharge the ink toward the sheet in response to the carriage being placed in a discharging position when the sheet is in a nipped condition, in which the sheet is nipped by the conveyer roller unit; and a corrected discharging step, in which the recording head is manipulated to discharge the ink toward the sheet in response to the carriage being placed in a corrected discharging position, where the corrected discharging position is different from the discharging position, when the sheet is in a non-nipped condition, in which the sheet is not nipped by the conveyer roller unit.

2. The inkjet printer according to claim 1, wherein, in the recording step, the controller manipulates the recording head to discharge a droplet of ink toward the sheet for a first time since the movement of the carriage in the recording step in response to the carriage being placed in a starting position; and wherein, in the discharging step, the controller sets the starting position to be the discharging position and, in the corrected discharging step, the controller sets the starting position to be the corrected position.

3. The inkjet printer according to claim 2, further comprising a memory device configured to store a shifted amount, wherein, in the corrected discharging step, the controller sets a position shifted from the discharging position for the shifted amount to be the corrected position.

4. The inkjet printer according to claim 3, wherein the shifted amount stored in the memory device indicates an amount for the sheet to be moved along the scanning direction when a condition of the sheet changes from the nipped condition to the non-nipped condition.

5. The inkjet printer according to claim 1, wherein the operation further comprises a detecting step, in which a position of a tail end of the sheet is detected;

wherein the controller executes the discharging step when the sheet is in the nipped condition with the tail end of the sheet detected being on an upstream side of the conveyer roller unit; and wherein the controller executes the corrected discharging step when the sheet is in the non-nipped condition with the tail end of the sheet detected being on a downstream side of the conveyer roller unit.

6. The inkjet printer according to claim 1, wherein the corrected discharging step comprises:

a first corrected discharging step, in which the recording head is manipulated to discharge the ink toward the sheet in response to the carriage being placed in a first corrected discharging position within the corrected discharging position when the sheet is in a first non-nipped condition, in which a tail end of the sheet is on an upstream side of the corrugating position, within the non-nipped condition; and a second corrected discharging step, in which the recording head is manipulated to discharge the ink toward the sheet in response to the carriage being placed in a second corrected discharging position within the corrected discharging position when the sheet is in a second non-nipped condition, in which the tail end of the sheet is on a downstream side of the corrugating position, within the non-nipped condition.

7. The inkjet printer according to claim 6, wherein, in the recording step, the controller manipulates the recording head to discharge a droplet of ink toward the sheet for a first time since the movement of the carriage in the recording step in response to the carriage being placed in a starting position;

wherein, in the discharging step, the controller sets the starting position to be the discharging position;

wherein, in the first corrected discharging step, the controller sets the starting position to be the first corrected position; and wherein, in the second corrected discharging step, the controller sets the starting position to be the second corrected position.

8. The inkjet printer according to claim 6, further comprising:

a memory device configured to store a first shifted amount and a second shifted amount, wherein, in the first corrected discharging step, the controller sets a position shifted from the discharging position for the first shifted amount to be the first corrected position, and in the second corrected discharging step, the controller sets a position shifted from the discharging position for the second shifted amount to be the second corrected position.

9. The inkjet printer according to claim 8, wherein the first shifted amount stored in the memory device indicates an amount for the sheet to be moved along the scanning direction when the condition of the sheet changes from the nipped condition to the first non-nipped condition; and wherein the second shifted amount stored in the memory device indicates an amount for the sheet to be moved along the scanning direction when the condition of the sheet changes from the nipped condition to the second non-nipped condition.

10. The inkjet printer according to claim 6, wherein, in the discharging step, the controller manipulates the recording head to discharge the ink toward a targeted position on the sheet at a first discharging timing;

wherein, in the second corrected discharging step, the controller manipulates the recording head to discharge the ink toward the targeted position on the sheet at a second discharging timing which is deviated from the first discharging timing, the farther the targeted position being separated from a reference position on the sheet along the scanning direction, the more largely the second discharging timing being deviated from the first discharging timing;

wherein the second discharging timing to discharge the ink toward the targeted position on an upstream side of the reference position in a moving orientation of the carriage is advanced to be earlier than the first discharging timing wherein the second discharging timing to discharge the ink toward the targeted position on a downstream side of the reference position in the moving orientation of the carriage is delayed to be later than the first discharging timing.

11. The inkjet printer according to claim 10, wherein the corrugation mechanism is configured to shape the sheet into the corrugated shape having a plurality of protrusive points, at which tendency of the amount of the gap between the recording head and the sheet turns from decreasing to increasing, and a plurality of recessed points, at which the tendency of the amount of the gap between the recording head and the sheet turns from increasing to decreasing, the protrusive points and the recessed points being formed alternately along the scanning direction;

wherein the targeted position toward which the ink is discharged in the discharging step includes a plurality of targeted positions on the protrusive points and the recessed points;

wherein the inkjet printer further comprises a memory device configured to store:

a reference value indicating a reference discharging timing;

a plurality of protrusion deviation values used to delay the first discharging timing for the protrusive points from the reference discharging timing;

a plurality of recess deviation values used to advance the first discharging timing for the recessed points from the reference discharging timing; and a plurality of adjusting values used to adjust the protrusion deviation values and the recess deviation values;

wherein the farther the targeted positions on the protrusive points and the recessed points being separated from the reference position toward the upstream side of the reference position in the moving orientation of the carriage, the more largely the adjusting values decrease the protrusion deviation values and the recess deviation values; and the farther the targeted positions on the protrusive points and the recessed points being separated from the reference position toward the upstream side of the reference position in the moving orientation of the carriage, the more largely the adjusting values increase the protrusion deviation values and the recess deviation values;

wherein, in the discharging step, the controller manipulates the recording head to discharge the ink toward the targeted positions on the protrusive points and the recessed points at the first discharging timings, which are deviated from the reference value for lengths corresponding to the protrusion deviation values and the recess deviation values; and wherein, in the second corrected discharging step, the controller manipulates the recording head to discharge the ink toward the targeted positions on the protrusive points and the recessed points at the second discharging timings, which are deviated from the reference value for lengths corresponding to the protrusion deviation values adjusted by the adjusting values and the recess deviation values adjusted by the adjusting values.

12. The inkjet printer according to claim 11, wherein, the farther the targeted positions on the protrusive points and the recessed points on the upstream side of the reference position in the moving orientation are separated from the reference position, the smaller adjusting values being smaller than or equal to 0 are applied to the protrusion deviation values and the recess deviation values;

wherein, the farther the targeted positions on the protrusive points and the recessed points on the downstream side of the reference position in the moving orientation are separated from the reference position, the greater adjusting values being greater than or equal to 0 are applied to the protrusion deviation values and the recess deviation values; and wherein the protrusion deviation values and the recess deviation values are adjusted by adding the adjusting values to the protrusion deviation values and the recess deviation values.

13. The inkjet printer according to claim 11, wherein, in the discharging step, the controller manipulates the recording head to discharge the ink toward the targeted position in a transitional position between adjoining protrusive point and recessed point at the first discharging timing, which is deviated from the reference value for a length corresponding to a deviation value, the deviation value being obtained by filling a predetermined interpolating function with the protrusion deviation value and the recess deviation value for the adjoining protrusive point and recessed point; and wherein, in the second corrected discharging step, the controller manipulates the recording head to discharge the ink toward the targeted position in the transitional position at the second discharging timing, which is deviated from the reference value for a length corresponding to an adjusted deviation value, the adjusted deviation value being obtained by filling the predetermined interpolating function with the protrusion deviation value and the recess deviation value adjusted by the adjusting values for the adjoining protrusive point and recessed point.

14. The inkjet printer according to claim 11, wherein the reference value indicates a length of time period, which is required for the ink discharged from the recording head to land on a center position among the protrusive points and the recessed points on the sheet;

wherein the protrusion deviation values indicate distances between a reference discharging position, at which the recording head should discharge the ink toward the center position, and protrusion-targeted discharging positions, at which the recording head should discharge the ink toward the protrusive points, along the scanning direction;

wherein the recess deviation values indicate distances between the reference discharging position and recess-targeted discharging positions, at which the recording head should discharge the ink toward the recess points, along the scanning direction;

wherein the adjusting values indicate distances which adjust the protrusion deviation values and the recess deviation values according to the shape of the sheet;

wherein the controller calculates the first discharging timing by dividing the protrusion deviation values and the recess deviation values by a moving velocity of the carriage and adding the quotients to the reference value; and wherein the controller calculates the second discharging timing by dividing the protrusion deviation values adjusted by the adjusting values and the recess deviation values adjusted by the adjusting values by the moving velocity of the carriage and adding the quotients to the reference value.

15. The inkjet printer according to claim 6, wherein the operation further comprise a detecting step, in which a position of a tail end of the sheet is detected;

wherein the controller executes the discharging step when the sheet is in the nipped condition with the tail end of the sheet detected being on an upstream side of the conveyer roller unit;

wherein the controller executes the first corrected discharging step when the sheet is in the first non-nipped condition, in which the tail end of the sheet is in a position between the conveyer roller unit and the corrugating position; and wherein the controller executes the second corrected discharging step when the sheet is in the second non-nipped condition, in which the tail end of the sheet is on the downstream side of the corrugating position.

16. The inkjet printer according to claim 1, further comprising a platen configured to support the sheet, toward which the recording head discharges the ink;

wherein the corrugation mechanism comprises:

a plurality of contact pieces arranged on an upstream side of the recording head with regard to the conveyance direction in positions spaced apart from one another along the scanning direction, the plurality of contact pieces being arranged to be in contact with an upper surface of the sheet; and a plurality of ribs formed on the platen and arranged to contact a lower surface of the sheet at upper positions with respect to lower ends of the contact pieces.

17. The inkjet printer according to claim 1, wherein the controller repeats the conveying step and the recording step alternately.

18. An inkjet printer, comprising:

a conveyer comprising a conveyer roller unit, the conveyer roller unit being configured to nip a sheet and convey the sheet along a conveyance direction;

a recording head configured to discharge ink toward the sheet conveyed by the conveyer;

a carriage mounting the recording head thereon and configured to move along a scanning direction;

a corrugation mechanism configured to shape the sheet into a corrugated shape at a corrugating position between the conveyer roller unit and the recording head; and a controller configured to execute an operation comprising:

a conveying step, in which the sheet is conveyed by the conveyer; and a recording step, in which the carriage is moved and the recording head is manipulated to discharge ink toward the sheet, wherein the recording step comprises:

a discharging step, in which the recording head is manipulated to discharge the ink toward the sheet in response to the carriage being placed in a discharging position when a tail end of the sheet is in a position on a downstream side of the conveyer roller unit; and a corrected discharging step, in which the recording head is manipulated to discharge the ink toward the sheet in response to the carriage being placed in a corrected discharging position, where the corrected discharging position is different from the discharging position, when the tail end of the sheet is in a position between the conveyer roller unit and the corrugating position.

19. A method comprising steps of:

conveying the sheet by a conveyer comprising a conveyer roller unit, the conveyer roller unit being configured to nip the sheet and convey the sheet; and recording by moving a carriage in a scanning direction, and manipulating a recording head mounted on the carriage to discharge ink toward the sheet shaped into a corrugated shape along the scanning direction, wherein the step of recording comprises:

a discharging step, in which the recording head is manipulated to discharge the ink toward the sheet in response to the carriage being placed in a discharging position when the sheet is in a nipped condition, in which the sheet is nipped by the conveyer roller unit; and a corrected discharging step, in which the recording head is manipulated to discharge the ink toward the sheet in response to the carriage being placed in a corrected discharging position, where the corrected discharging position is different from the discharging position, when the sheet is in a non-nipped condition, in which the sheet is not nipped by the conveyer roller unit.

20. The method according to claim 19, wherein, in the discharging step, the recording head is manipulated to discharge a droplet of ink toward the sheet for a first time since the movement of the carriage in the recording step in response to the carriage being placed in the discharging position and;

wherein, in the corrected discharging step, the recording head is manipulated to discharge a droplet of ink toward the sheet for a first time since the movement of the carriage in the recording step in response to the carriage being placed in the corrected discharging position.

* * * * *